US010365062B2

(12) United States Patent
Oesch et al.

(10) Patent No.: US 10,365,062 B2
(45) Date of Patent: Jul. 30, 2019

(54) MODULAR PROTECTIVE SYSTEM (MPS) EXPEDIENT GUARD TOWER AND FIGHTING POSITION

(71) Applicants: Tyler S. Oesch, Berlin (DE); Matthew S. Holmer, Clinton, MS (US); Bradford A. Steed, Vicksburg, MS (US); Amy M. Allen, Clinton, MS (US); Andrew B. Edwards, Toney, AL (US)

(72) Inventors: Tyler S. Oesch, Berlin (DE); Matthew S. Holmer, Clinton, MS (US); Bradford A. Steed, Vicksburg, MS (US); Amy M. Allen, Clinton, MS (US); Andrew B. Edwards, Toney, AL (US)

(73) Assignee: THE UNITED STATES OF AMERICA AS REPRESENTED BY THE SECRETARY OF THE ARMY, Alexandria, VA (US)

( * ) Notice: Subject to any disclaimer, the term of this patent is extended or adjusted under 35 U.S.C. 154(b) by 412 days.

(21) Appl. No.: 14/212,997

(22) Filed: Mar. 14, 2014

(65) Prior Publication Data

US 2017/0114562 A1 Apr. 27, 2017

(51) Int. Cl.
*E04H 12/18* (2006.01)
*E04H 1/02* (2006.01)
(Continued)

(52) U.S. Cl.
CPC ..... *F41A 23/02* (2013.01); *E04B 1/34315* (2013.01); *E04H 12/08* (2013.01);
(Continued)

(58) Field of Classification Search
CPC ..... E04H 1/02; E04H 1/12; E04H 1/1205; E04H 7/00; E04H 9/00; E04H 9/04;
(Continued)

(56) References Cited

U.S. PATENT DOCUMENTS 2,793,401 A * 5/1957 Paschke ..... E04H 1/12 52/264
3,461,633 A * 8/1969 Ziegelman ..... E04B 1/24 52/643
(Continued)

*Primary Examiner* — Phi D A
(74) *Attorney, Agent, or Firm* — Brian C. Jones

(57) ABSTRACT

A modular protective system (MPS) Expedient Guard Tower and Fighting Position meeting multiple criteria for deployment and re-deployment in austere combat environments is disclosed as well as methods of assembly. The MPS Expedient Guard Tower and Fighting Position is lightweight such that it can be easily deployed by helicopter, requires no tools or equipment to assemble, and can be assembled very quickly by a team of four to six soldiers. The Modular Protective System (MPS) Expedient Guard Tower and Fighting Position can be easily recovered, i.e., disassembled and redeployed to a different location and as the title of the invention suggests, it is capable of being constructed in a non-elevated position or an elevated position. Accordingly, it may be used either as a guard tower, a fighting position, or an inspection station, etc., depending upon the particular need.

20 Claims, 34 Drawing Sheets

(51) Int. Cl.

| | |
|---|---|
| ***E04H 12/34*** | (2006.01) |
| ***F41A 23/02*** | (2006.01) |
| ***E04B 1/343*** | (2006.01) |
| ***E04H 12/08*** | (2006.01) |
| ***F41H 5/24*** | (2006.01) |
| ***E04H 12/20*** | (2006.01) |
| *E04H 1/12* | (2006.01) |

(52) U.S. Cl.
CPC ..... *E04H 12/20* (2013.01); *F41H 5/24* (2013.01); *E04B 2001/34389* (2013.01); *E04H 1/02* (2013.01); *E04H 1/12* (2013.01)

(58) Field of Classification Search
CPC ..... E04H 9/10; E04H 12/18; E04H 12/08; E04H 12/34; F41H 5/24
See application file for complete search history.

(56) References Cited

U.S. PATENT DOCUMENTS

| | | | | | |
|---|---|---|---|---|---|
| 3,973,367 | A * | 8/1976 | Johnson | E04B 7/02 | 52/15 |
| 4,078,341 | A * | 3/1978 | Peterson | E04B 1/3447 | 52/71 |
| 4,850,161 | A * | 7/1989 | McGinnis | E04H 12/18 | 52/108 |
| 5,386,788 | A * | 2/1995 | Linker | E05G 1/024 | 109/58 |
| 8,517,037 | B1 * | 8/2013 | Vazquez | A01M 31/02 | 135/143 |
| 8,677,698 | B2 * | 3/2014 | Segall | E04B 1/34315 | 52/127.11 |
| 2006/0277852 | A1 * | 12/2006 | Mower | E04H 1/1205 | 52/270 |
| 2007/0044411 | A1 * | 3/2007 | Meredith | E04B 1/14 | 52/586.1 |
| 2014/0318036 | A1 * | 10/2014 | Eom | E02D 27/12 | 52/79.1 |

* cited by examiner

MODULAR PROTECTIVE SYSTEM (MPS) EXPEDIENT GUARD TOWER AND FIGHTING POSITION

FIELD OF THE INVENTION

The invention relates to a Modular Protective System (MPS) Expedient Guard Tower and Fighting Position meeting multiple criteria for deployment and re-deployment in austere combat environments.

BACKGROUND OF THE INVENTION

The recent wars in Iraq and Afghanistan have highlighted the need for force protection technologies that are suited for employment in austere combat environments. The guard tower systems that are currently employed by the U.S. Army and other armed forces in combat theaters, however, fail to meet several requirements. These current guard towers tend to be either logistically intensive, require excessive manpower and machinery for assembly, or provide inadequate ballistic protection.

There is a need for a lightweight guard tower or fighting position having a weight significantly less than 10,000 pounds such that it can be easily deployed by helicopter. There is a need for a guard tower or fighting position that requires no tools or equipment to assemble it. There is a need for such assembly without tools or equipment to take place very quickly and with no special training. There is a need for such a guard tower or fighting position to provide significant ballistic protection to the occupant. There is a need for such a guard tower or fighting position to be easily disassembled and redeployed to a different location.

SUMMARY OF THE INVENTION

The invention provides a Modular Protective System (MPS) Expedient Guard Tower and Fighting Position which is a significant leap forward over current three protection technologies. The Modular Protective System (MPS) Expedient Guard Tower and Fighting Position of the present invention is lightweight, and specifically has a weight significantly less than 10,000 pounds, and in certain embodiments less than 8,000 pounds, such that it can be easily deployed by helicopter. The invention also provides a guard tower or lighting position that requires no tools or equipment to assemble, and can be assembled very quickly by a team of five to six soldiers in 60-120 minutes without tools or equipment and requires no special training. The invention also provides significant ballistic protection to the occupant. The Modular Protective System (MPS) Expedient Guard Tower and Fighting Position of the present invention can be easily recovered, i.e., disassembled and redeployed to a different location.

As the title of the invention suggests, the MPS Expedient Guard Tower and Fighting Position is capable of being constructed in a non-elevated position, or an elevated position. Accordingly, the invention may be used either as a guard tower, a fighting position, or an inspection station, etc., depending upon the particular need.

In general, it is noted that one of the main features of the embodiments of the invention is that they may be hand-assembled in the field, in particular, this may include hostile environments. "Hand-assembled" in the context of this invention means that the assembly of the guard towers and lighting positions of the invention requires absolutely no hand tools. More particularly, even the simplest of hand tools are not required, for example, a screwdriver, a pair of pliers, an adjustable wrench or any other of even the simplest tools. For the soldier to be a part of the small group required to assemble the guard towers and lighting positions in accordance with the invention, absolutely no tools or special training are required.

In embodiments of the invention, a modular, rapidly-deployable, hand-assembled, guard tower or fighting position structure is provided which is designed to withstand both horizontal and vertical loads. The guard tower or lighting position structure in accordance with certain embodiments of the invention comprises (a) optionally, a base having a plurality of attachment points, (b) a modular floor panel comprising: (i) an inner floor panel having a front side, a back side opposed to said front side, and two opposing sides, said front, back and two opposing sides defining an inner floor panel perimeter having four corners, said inner floor panel perimeter having channel material for receiving wall panels slidably engaged thereto, (ii) a front floor panel and a (iii) back floor panel, each of said front and back floor panels having an inner edge, and in contact with the opposed front and back side of the inner floor panel at said inner edges, respectively, two (iv & v) opposing side floor panels, each of said side floor panels having an inner edge, and being slidably engaged with the inner floor panel and in contact with the opposed sides of the inner floor panel at said inner edges, said front floor panel, back floor panel, and two side floor panels defining an outer floor perimeter comprising a front, back and two sides, said outer floor panel perimeter having channel material for receiving wall panels attached thereto, wherein said floor panel is in connection with said optional base at said plurality of attachment points, (c) optionally, at least one stabilizer arm attached to and extending outwardly from each of said four inner floor panel corners, (d) at least four columns, having bottoms attached to and extending upwardly from said four inner floor panel corners, and tops, (e) float, back, and opposed inner side wall panels having bottom edges and top edges, and extending upwardly from and having said bottom edges slidably engaged with the inner floor panel perimeter channel, (f) front, back, and opposed outer side wall panels having bottom edges and top edges, and extending upwardly from and having said bottom edges slidably engaged with the outer floor panel perimeter channel, (g) front, back, and two opposing side window sills having a top and a bottom and having inner and outer channel material attached to the bottom of each of said window sills for receiving the top edges of said inner and outer wall panels, respectively and slidably engaged therewith to form an inner and outer wall having a cavity therebetween, and (h) a roof assembly attached to the tops of said four columns.

In embodiments of the invention the guard tower may have an elevated base and further comprises entry means slidably engaged with the modular floor panel. The entry means may be a ladder, a stairway, or other suitable entry means. The guard tower may additionally have an opening in the inner wall panels, the outer wall panels and the window sills corresponding to the placement of the entry means. The inner floor panel may be one-piece or may be comprised of a middle section, and two end sections.

In embodiments of the invention the guard tower may have four variable length, extendable stabilizer arms, one extending outwardly from each of said four inner floor panel corners, and having a proximate end and a distal end, said proximate end attached to one of said four inner floor panel corners and, said distal end terminating in a stabilizer pad in contact with a surface, wherein each stabilizer pad is connected to three tensioning means, two of said three tensioning means being attached to the adjacent stabilizer pads to the left and right, and the remaining third tensioning means attached to a closest point of said base, wherein a total of eight tensioning means attach and tension tour stabilizer arms to each other and to the base to form a stabilizer system which acts to resist a tipping movement of the guard tower by placing one or more of the stabilizer arms in simple compression.

In embodiments of the invention the guard tower base may be at an incline angle of up to 10° from horizontal. In embodiments of the invention the guard tower may be in kit form wherein all disassembled parts are placed within the Quadcon base, such that the base acts as a shipping and storage container for the disassembled parts.

In embodiments of the invention the guard tower structure roof assembly may comprise two extendable longitudinal roof beams, each attached to a pair of the four columns, and running in a parallel direction to the two opposing sides of the inner floor panel, a middle transverse roof beam having channels on either side thereof to slidably receive roof panels, said middle roof beam attached to said two longitudinal roof beams in a position transverse to said two longitudinal roof beams, and central to front and back ends of said longitudinal roof beams, a transverse front roof end beam attached in a position transverse to said two longitudinal roof beams and at a front end of the structure, said transverse front roof end beam having a channel on a side facing the middle roof beam to slidably receive roof panels, said channel having an extended bottom lip, a transverse back roof end beam attached in a position transverse to said two longitudinal roof beams and at a back end of the structure, said transverse back roof-end beam having a channel on a side facing the middle roof beam to slidably receive roof panels, said channel having an extended bottom lip, and roof panels extending between said middle roof beam and said front roof end beam, and roof panels extending between said middle roof beam and said back roof end beam, wherein the extended lip allows installation of the roof panels from an underneath protected position by slidably engaging said panels between said beams in a position wherein the distance between beams is greater than a final position and said panels are supported by said extended lip, and then moving the beams to a final position wherein said roof panels are fully engaged in said channels in said final beam position.

In embodiments of the invention the guard tower assembly has modular floor panel, and the outer floor perimeter channel and the window sills have a rectangular or a square configuration and also have all four corners of said rectangle or square configuration truncated at an angle, defining an eight-sided outer wall.

In embodiments of the invention the guard tower assembly has at least one weapon mount, which may be attached to the floor behind an outer wall and projects through a hole in a window sill.

DESCRIPTION OF THE DRAWINGS AND DETAILED DESCRIPTION OF THE INVENTION

Figure 1A:
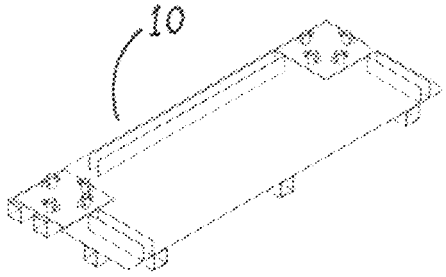
FIG. 1A depicts an inner floor panel end section (10) which may be made from structural grade steel and weighs approximately 203 pounds. In embodiments of the invention, there are two inner floor panel end sections used per guard tower.
Figure 1B:
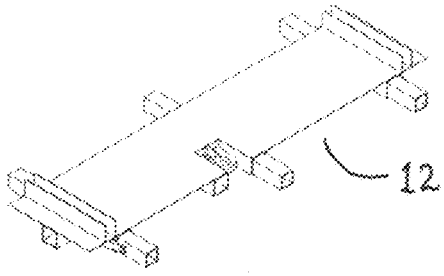
FIG. 1B depicts an inner floor panel middle section (12) which may be made from structural grade steel and weighs approximately 126 pounds. In embodiments of the invention, there is one inner floor panel middle section used per guard tower.
Figure 1C:
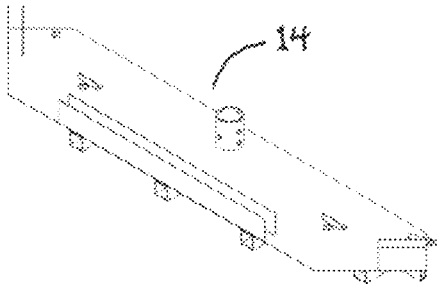

FIG. 1C depicts the front/back floor panel (14) which may be made from structural grade steel with a central pipe attached which is made from stainless steel. A single front/back floor panel weighs approximately 111 pounds. In embodiments of the invention, there are two such panels used per guard tower, a front floor panel and a back floor panel.

Figure 1D:
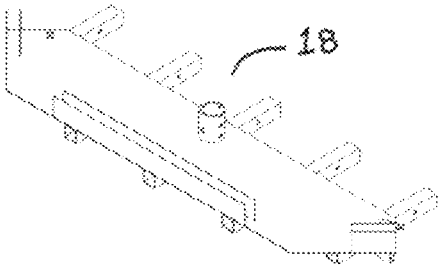

FIG. 1D depicts a cantilevered side floor panel (18) which may be made from structural grade steel with a central pipe attached which is made from stainless steel. A single cantilevered side floor panel weighs approximately 102 pounds. In embodiments of the invention, there are two cantilevered side floor panels used per guard tower.

Figure 2A:
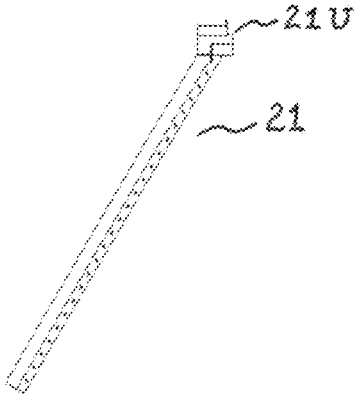
Figure 48:
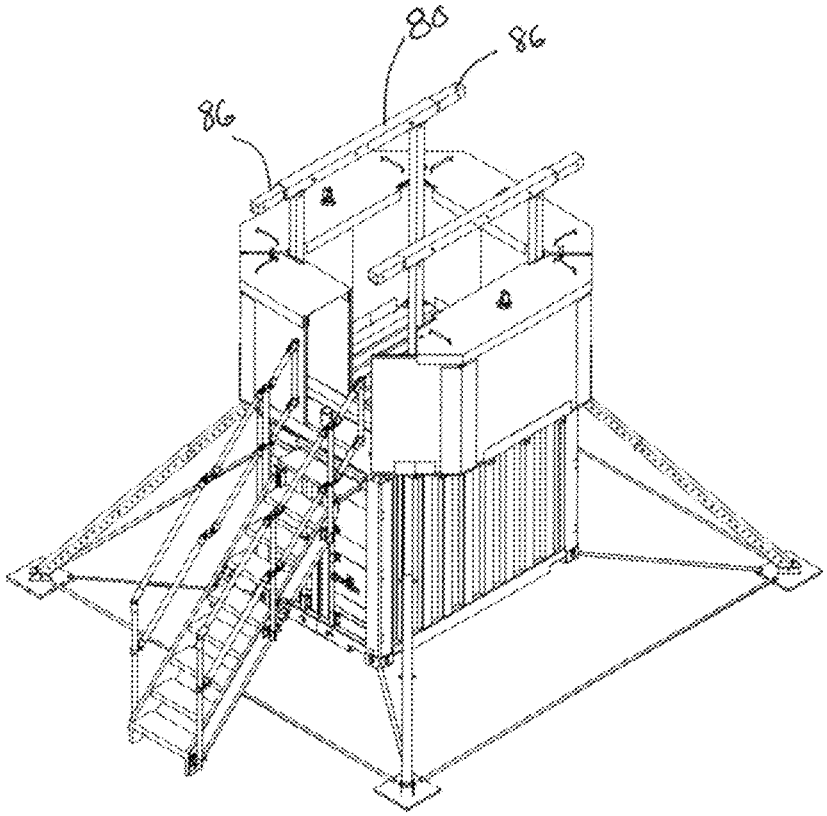
Figure 49:
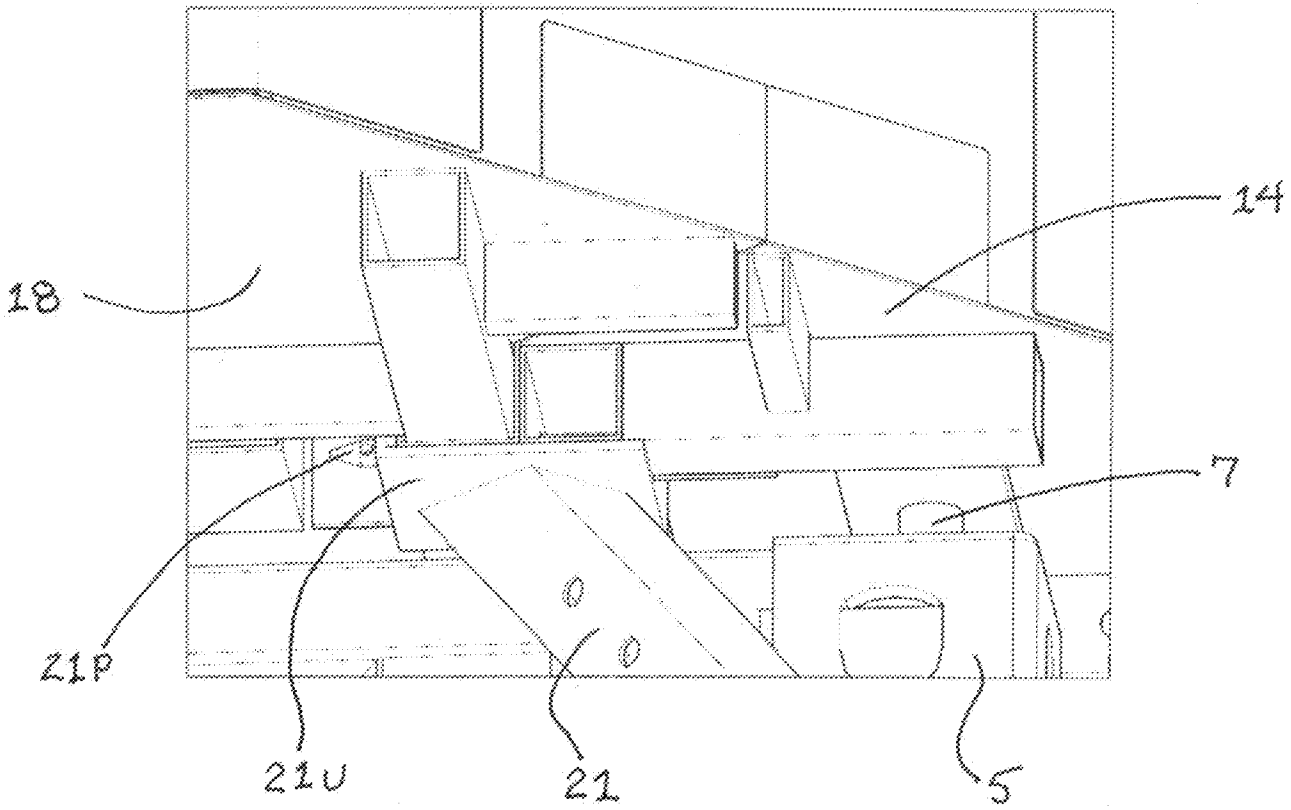

FIG. 2A depicts an upper stabilizing arm section (21) which may be made from structural grade steel and weighs approximately 34 pounds. Upper flange (21U) is designed to engage with the combined floor sections as shown in FIG. 48 and FIG. 49. In embodiments of the invention, there are four upper stabilizer arm sections used per guard tower.

Figure 2B:
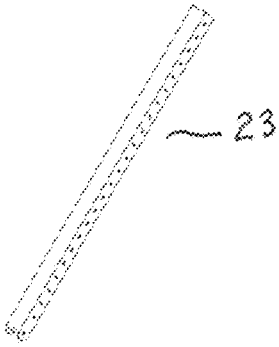

FIG. 2B depicts a lower stabilizing arm section (23) which may be made from structural grade steel and weighs approximately 31 pounds. In embodiments of the invention, there are four lower stabilizer arm sections used per guard tower.

Figure 2C:
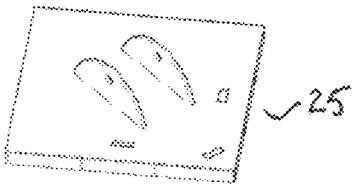

FIG. 2C depicts a stabilizer pad (25) which may be made from structural grade steel and weighs approximately 15 pounds. In embodiments of the invention, there are four stabilizer pads used per guard tower.

Figure 3:
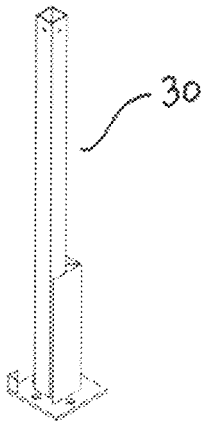

FIG. 3 depicts a roof support column (30) which may be made from structural grade steel and weighs approximately 79 pounds. In embodiments of the invention, there are four columns used per guard tower.

Figure 4A:
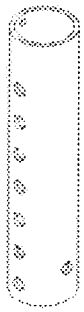

FIG. 4A depicts a lower pintle pole made from stainless steel and weighing approximately 10 pounds. In embodiments of the invention, there are three lower pintle poles used per guard tower.

Figure 4B:
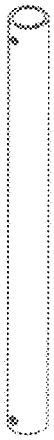

FIG. 4B depicts an upper pintle pole made from stainless steel and weighing approximately 22 pounds. In embodiments of the invention, there are three upper pintle poles used per guard tower.

Figure 4C:
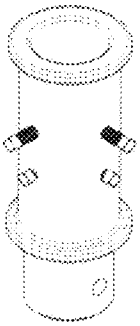

FIG. 4C depicts a pintle bearing sleeve made from stainless steel and weighing approximately 10 pounds. The pintle bearing sleeve may also be identified by NSN (National Stock Number) 3120-0 1-188-5082. In embodiments of the invention, there are three pintle bearing sleeves used per guard tower.

Figure 4D:
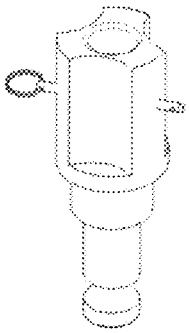

FIG. 4D depicts a pintle adapter weighing approximately 8 pounds. The pintle adapter may be also identified by NSN 1003-0 1-4 13-4098. In embodiments of the inventions there are three pintle adapters used per guard tower.

Figure 5A:
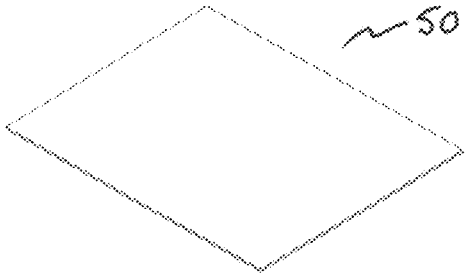

FIG. 5A depicts a full E-glass sheet (50) weighing approximately 110 pounds, and in embodiments of the invention, may be 4'×5'×0.5" thick. In embodiments of the invention, there are eight full E-glass sheets used per guard tower.

Figure 5B:
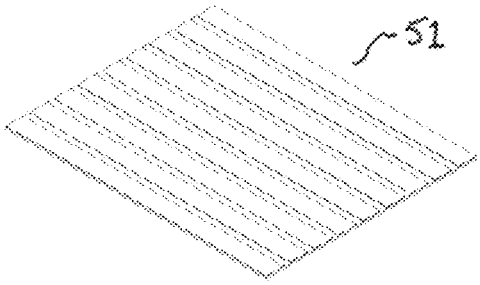
Figure 6C:
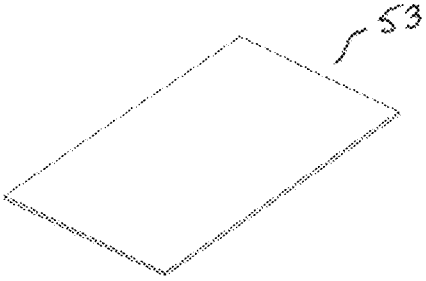

FIG. 5B depicts a full E-glass sheet (51) with grip tape for use on the floor of the guard tower and weighing approximately 110 pounds, and in embodiments of the invention may be 4'×5'×0.5" thick.

FIG. 5C depicts a half-size E-glass sheet (53) weighing approximately 55 pounds and having dimensions, in embodiments of the invention, of 4'×2.5'×0.5" thickness. In embodiments of the invention, there are 30 of the half E-glass sheets used per guard tower.

Figure 6:
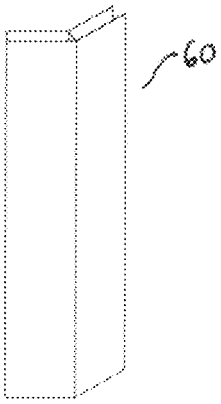

FIG. 6 depicts a corner sleeve (60) made from structural grade steel and weighing approximately 28 pounds. In embodiments of the invention, there are seven corner sleeves used per guard tower.

Figure 7B:
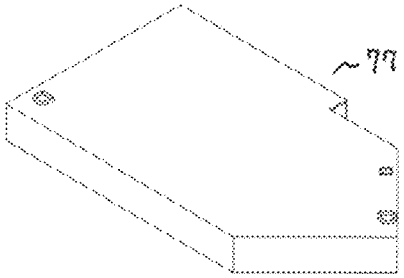
Figure 7A:
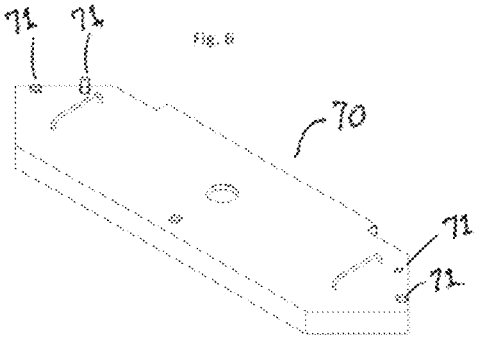

FIG. 7A depicts a full window sill (70) made from structural grade steel and weighing approximately 113 pounds. In embodiments of the invention, there are three of these window sills used per guard tower.

FIG. 7B depicts a half window sill (77) made from structural grade steel and weighing approximately 37 pounds. In embodiments of the invention, there is one half window sill used per guard tower.

Figure 8A:
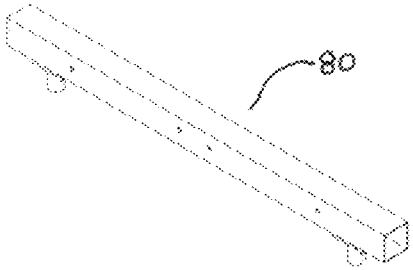

FIG. 8A depicts a longitudinal roof beam center section (80) made from structural grade steel and weighing approximately 50 pounds. In embodiments of the invention, there are two longitudinal roof beam center sections used per guard tower.

Figure 8B:
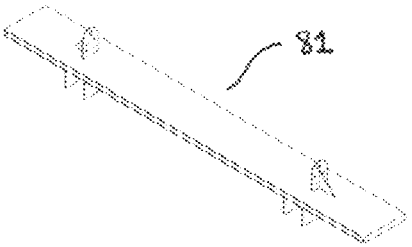

FIG. 8B depicts a middle transverse roof beam (81) made from structural grade steel and weighing approximately 137 pounds. In embodiments of the invention, there is one middle transverse roof beam used per guard tower.

Figure 8C:
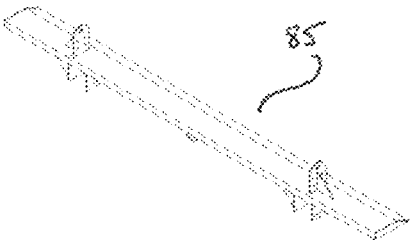
Figure 3D:
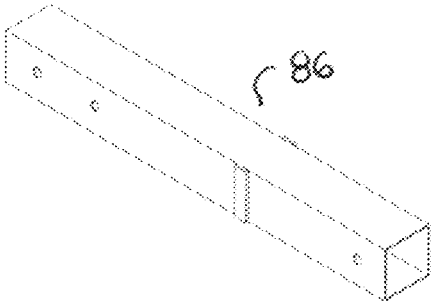
Figure 3B:
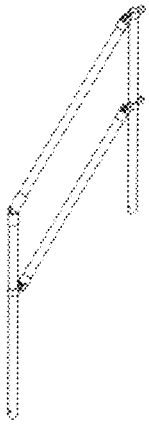
Figure 3A:
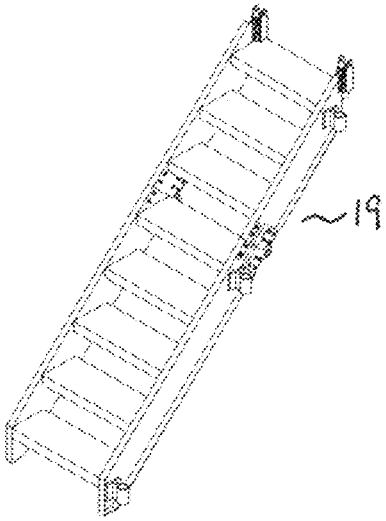
Figure 3C:
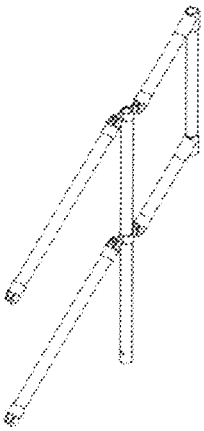
Figure 3D:
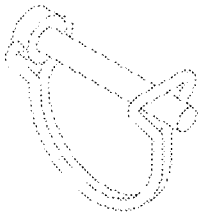

FIG. 8C depicts a transverse roof end beam (85) made from structural grade steel and weighing approximately 86 pounds. In embodiments of the invention, there are two transverse roof end beams used per guard tower, one front transverse roof end beam and one back transverse roof end beam.

FIG. 8D depicts a longitudinal roof beam extension (86) made from structural grade steel and weighing approximately 21 pounds. In embodiments of the invention, there are four longitudinal roof beam extensions used per guard tower.

FIG. 9A depicts aluminum stairs weighing approximately 80 pounds.

FIG. 9B deplete an aluminum lower stair railing weighing approximately 23 pounds.

FIG. 9C depicts an upper aluminum stair railing and weighing approximately 22 pounds.

FIG. 10 depicts a railing pin used for the stair railings.

Figure 11:
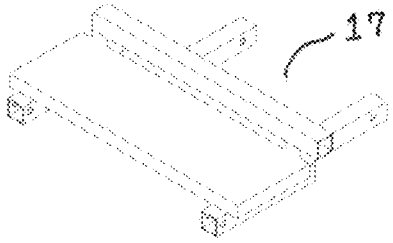

FIG. 11 depicts a stair platform (17) made from structural grade steel weighing approximately 35 pounds.

Figure 12:
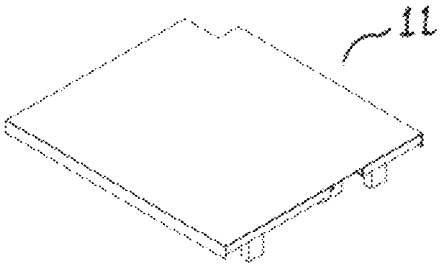

FIG. 12 depicts an entry cover (11) made from structural grade steel weighing approximately 51 pounds.

Figure 13:
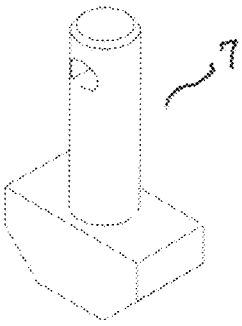

FIG. 13 depicts a Quadcon corner pin (7) made from structural grade steel weighing approximately 7 pounds, in embodiments of the invention, there are four Quadcon corner pins used per guard tower.

Figure 14:
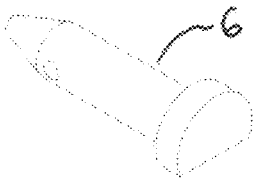

FIG. 14 depicts a flat bottom pin (6) of structural grade steel weighing approximately ½ pound. In embodiments of the invention, there are 20 flat bottom pins used per guard tower.

Figure 15:
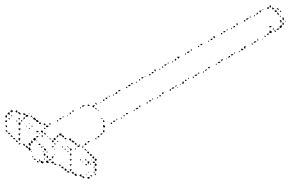

FIG. 15 depicts a T-handle pin of structural grade steel weighing approximately 1 pound. In embodiments of the invention, there are 3 T-handle pins used per guard tower.

Figure 16:
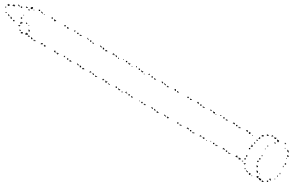

FIG. 16 depicts a long pin of structural grade steel weighing approximately 1 pound. In embodiments of the invention, there are 4 long pins used per guard tower.

Figure 17:
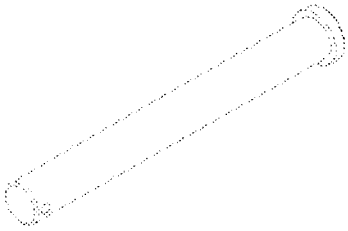

FIG. 17 depicts a standard pin of structural grade steel weighing approximately 1 pound. In embodiments of the invention, there are 49 standard pins used per guard tower.

Figure 18:
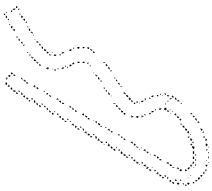

FIG. 18 depicts a cotter pin of structural grade steel. In embodiments of the invention, there are 73 cotter pins used per guard tower.

Figure 19:
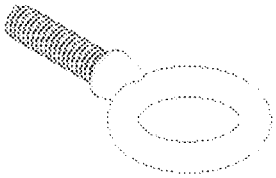

FIG. 19 depicts an eye bolt of structural grade steel. In embodiments of the invention, there are 7 eye bolts used per guard tower.

Figure 20:
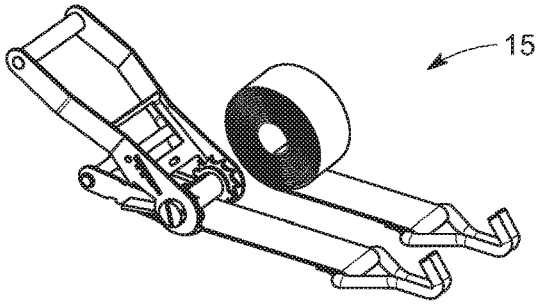

FIG. 20 depicts tensioning means (15) (e.g., a ratchet strap) having a minimum working load of 2000 pounds. In embodiments of the invention, there are 8 tensioning means used per guard tower.

Figure 21:
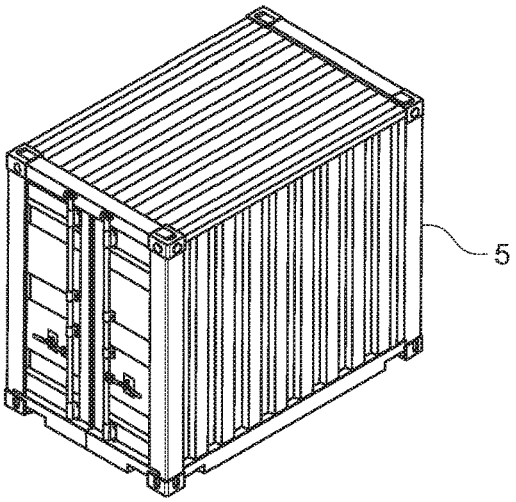

FIG. 21 depicts a Quadcon Type IIA container (5) having dimensions of 96" length×57.38" width×82" height.

Figure 22:
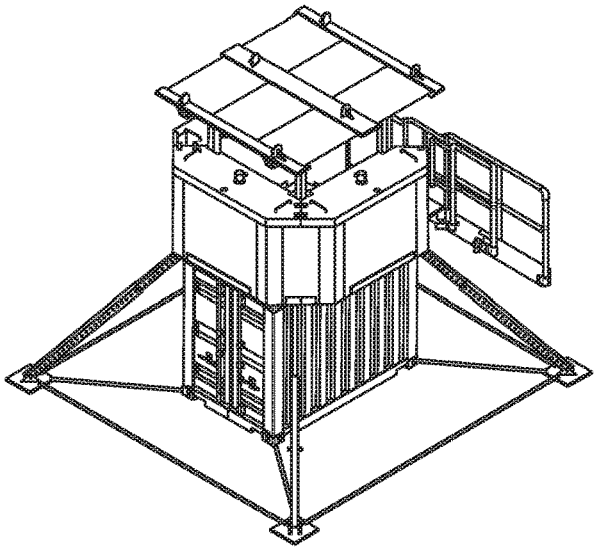

FIG. 22 depicts a fully assembled MPS guard tower system in accordance with an embodiment of the invention having approximate overall dimensions of 237× length× 192× width×173" height and weighing approximately 7657 pounds.

FIG. 23 is an isometric depiction of an embodiment of the guard tower of the present invention shown from a view looking down upon the side of the guard tower having stairs attached together with an opening for the stairs.

Figure 24:
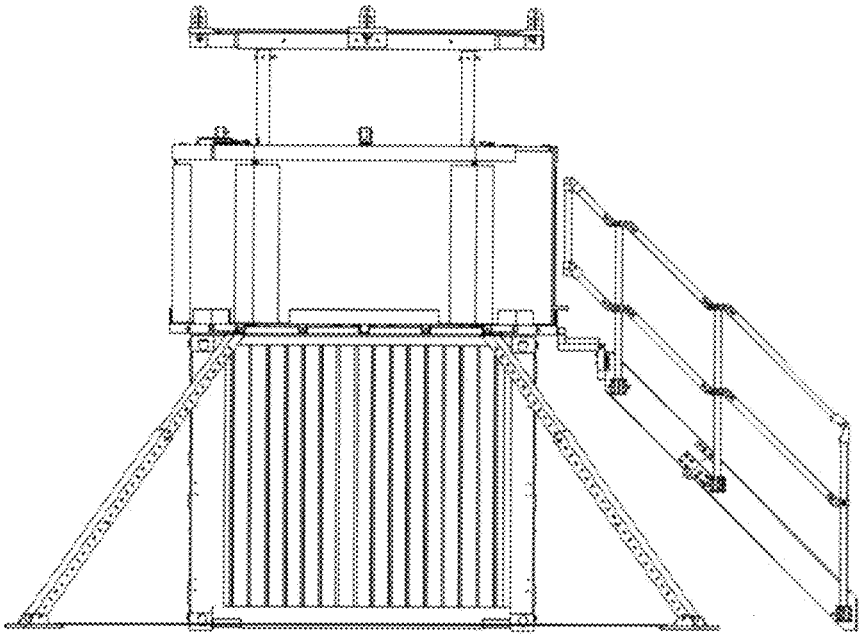

FIG. 24 depicts a side view of an embodiment of the guard tower of the present invention shown from the vantage point that is perpendicular to the plane of entry of the stairs in the stair opening.

Figure 25:
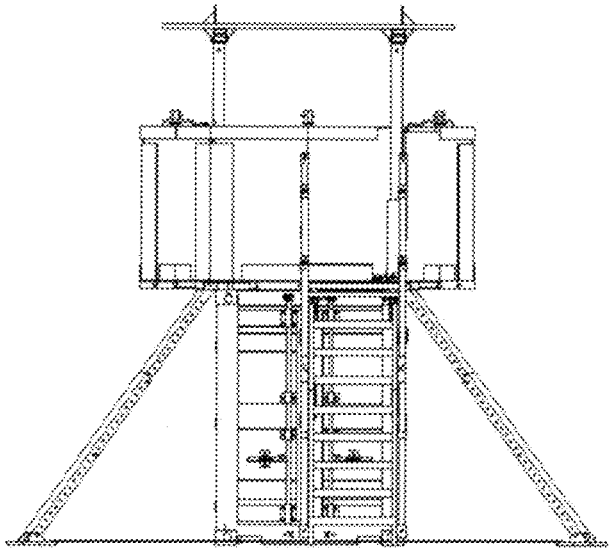

FIG. 25 depicts a side view of an embodiment of the guard tower of the present invention showing a vantage point of the side of the guard tower having the stairs and the stair opening.

Figure 26:
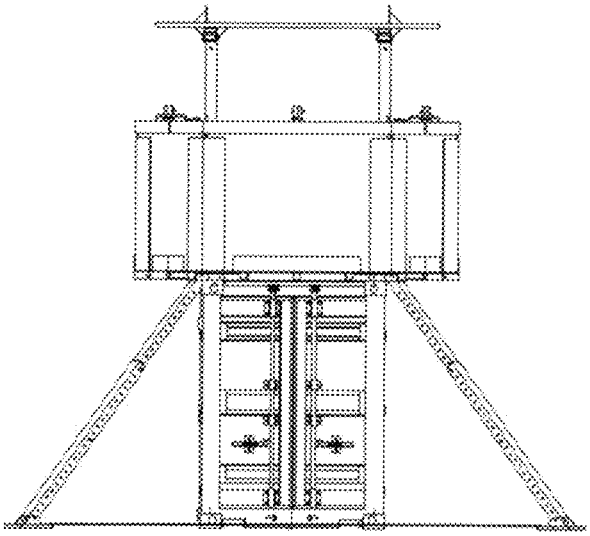

FIG. 26 depicts another side view of an embodiment of the guard tower in accordance with the present invention.

Figure 27:
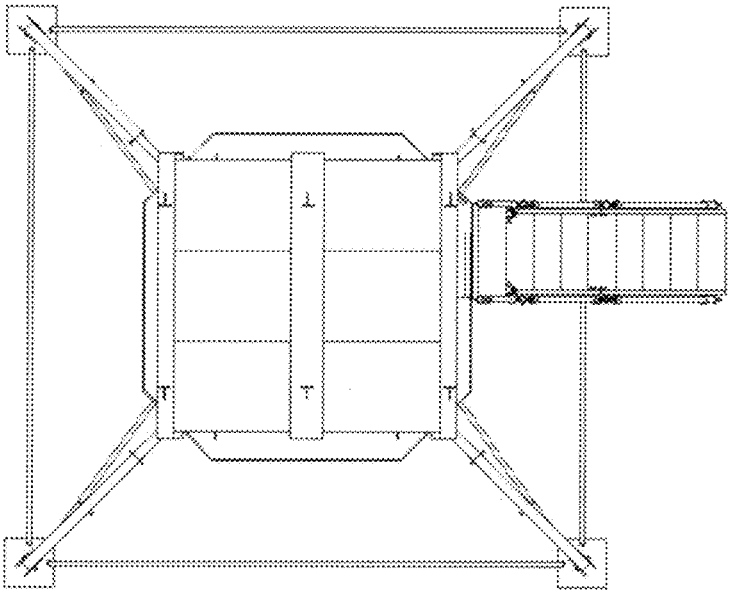

FIG. 27 depicts the top view of an embodiment of the guard tower in accordance with the present invention.

The following figures depict an assembly sequence for an embodiment of the guard tower of the present invention.

Figure 28A:
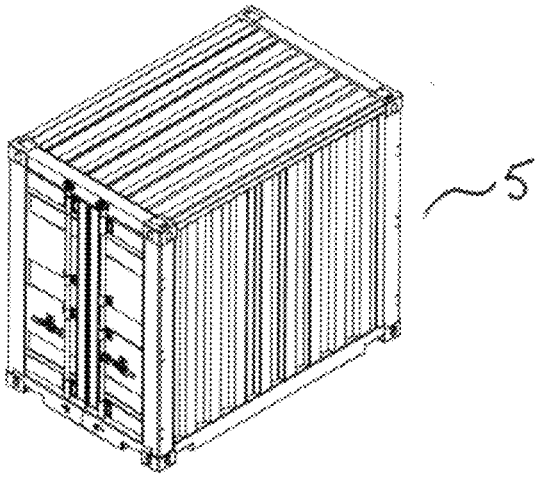

FIG. 28A is an isometric drawing depicting the Quadcon ISO container. In embodiments of the invention the container has sufficient space to house all of the individual pieces of the guard tower of the present invention.

Figure 28B:
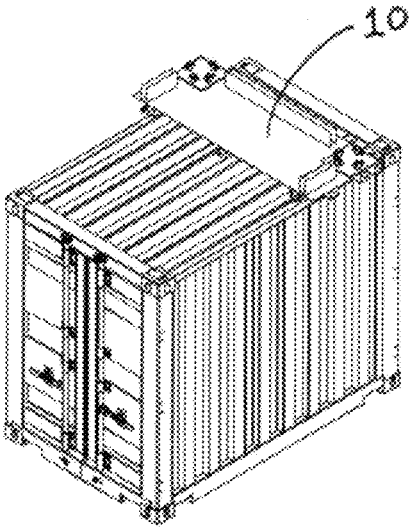

FIG. 28B is an isometric drawing depicting the placement of an end floor panel on top of the container.

Figure 28C:
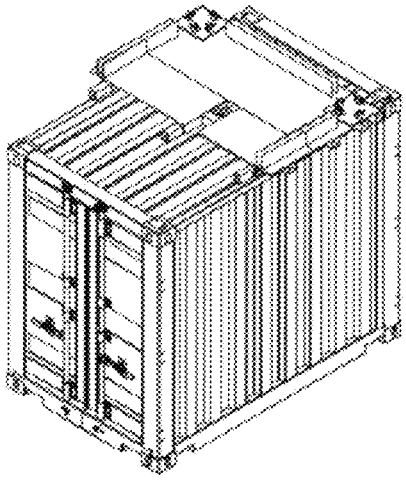

FIG. 28C is an isometric depiction of the placement of the center floor panel on top of the container after it has been slidably engaged with the end floor panel previously placed thereon.

Figure 28D:
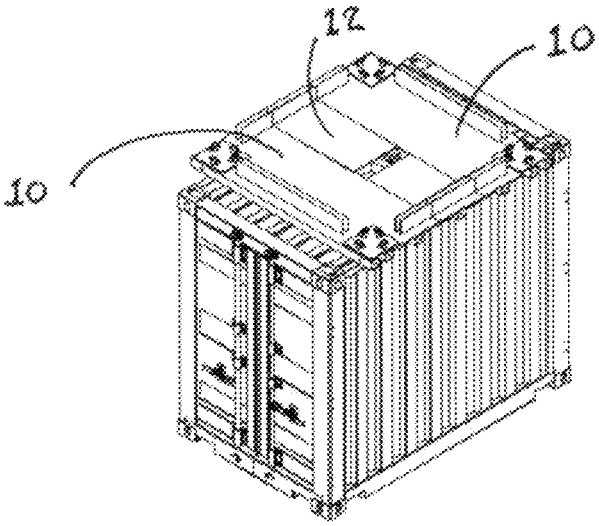

FIG. 28D is an isometric depiction of the full floor assembly wherein the second end floor panel has been, slidably engaged with the other side of the center floor panel, in certain embodiments of the invention this center 3-piece floor panel may be fabricated in one piece. However, the fabrication of the center floor panel as three individual pieces makes them much lighter and thus easier to handle.

Figure 29A:
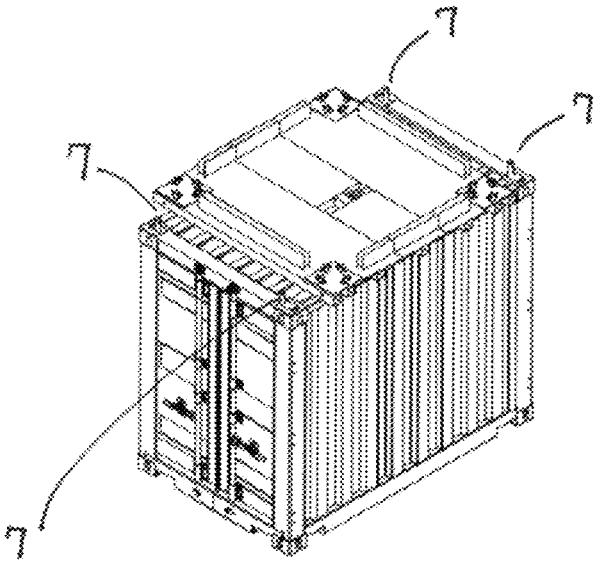

FIG. 29A is an isometric depiction wherein the four lock down pins have been placed into the corners on top of the Quadcon container.

Figure 29B:
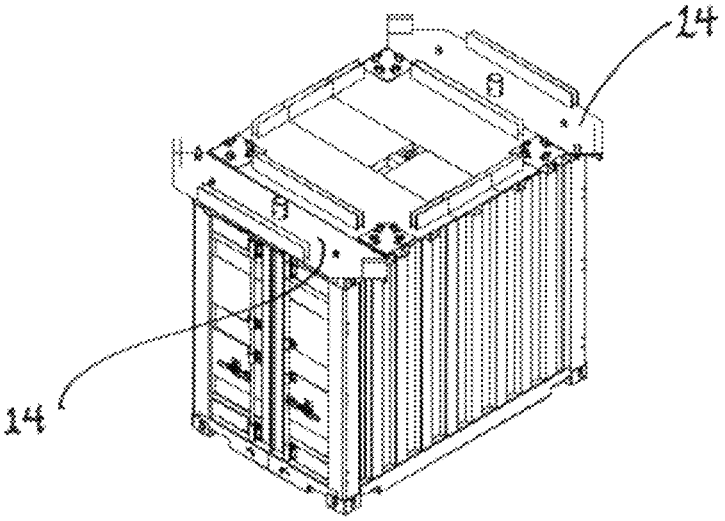

FIG. 29B is an isometric depiction wherein the front and back floor pieces have been placed over the lock down pins on top of the container.

Figure 29C:
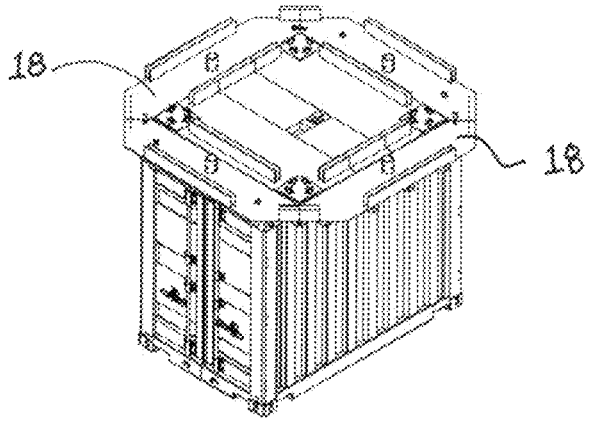

FIG. 29C is an isometric depiction showing the left and right cantilevered floor pieces which have been slidably engaged into the tubes on the assembled central floor plate and pinned into place with standard pins, the central floor section having been assembled as shown in FIGS. 28A-28D. The overhanging and/or extended floor sections are shown as assembled in FIGS. 29B-29C.

Figure 30:
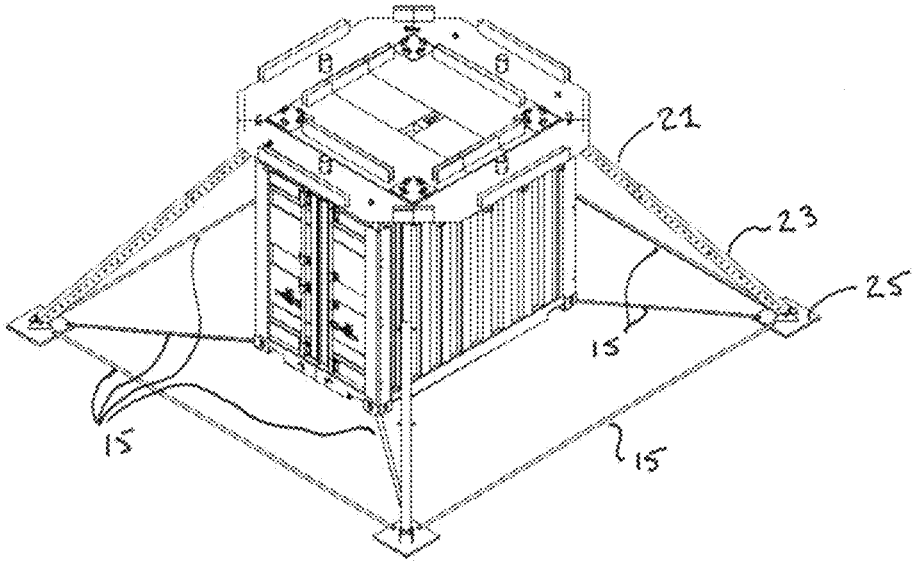

FIG. 30 is an isometric depiction showing the assembled stabilizer arms, pads and ratchet straps. The two sections (upper and lower) of the stabilizer arms are assembled. The upper part of each stabilizer arm is placed and pinned with a long pin into a corner of the floor (see detail below). The lower part of the stabilizer arms are connected to the four stabilizer pads and pinned with standard pins. Ratchet straps are attached and connected between adjacent stabilizer pads and between each stabilizer pad and the adjacent corner of the bottom of the Quadcon container.

Figure 31:
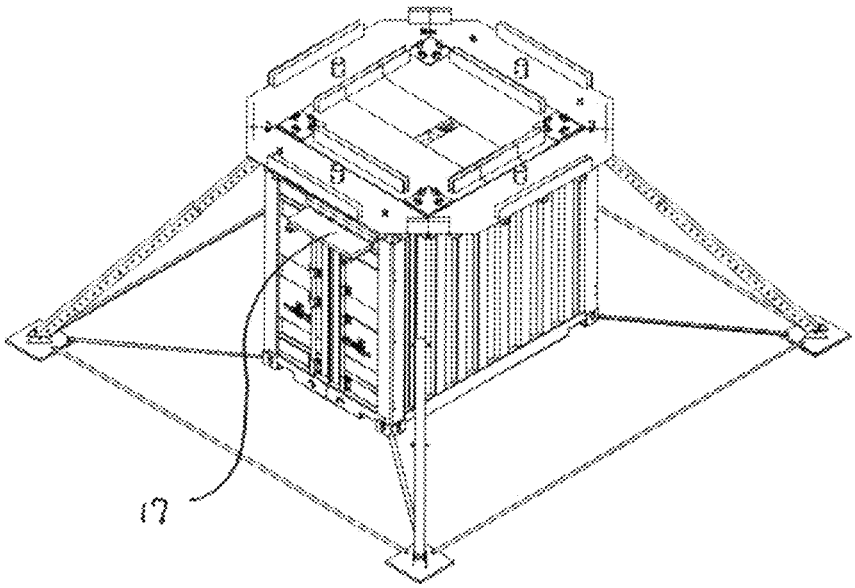

FIG. 31 is a depiction of the stair platform having been slidably engaged with the floor piece and pinned into place with standard pins.

Figure 32A:
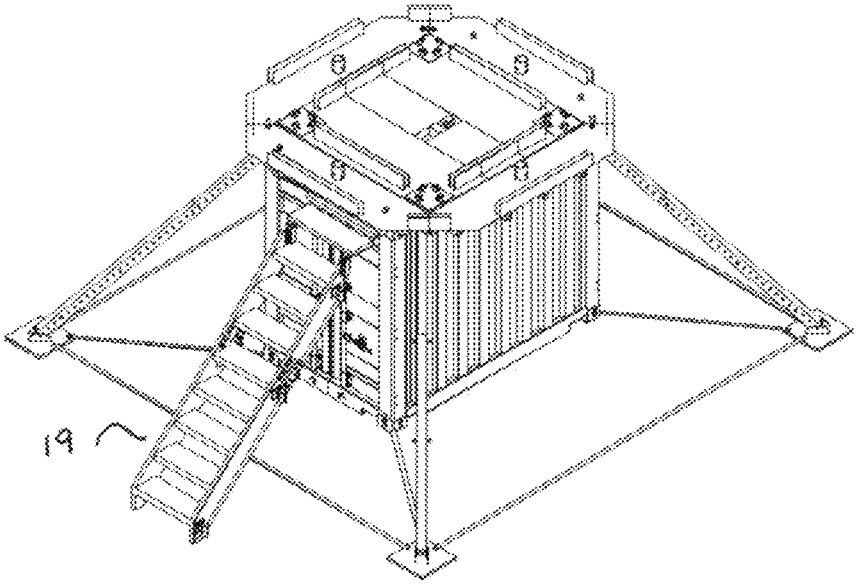

FIG. 32A is an isometric depiction of the stair section, which may have been folded during storage, having then been put into a straight extended position and pinned to the upper stair platform at the top of the stairs with standard pins.

Figure 32B:
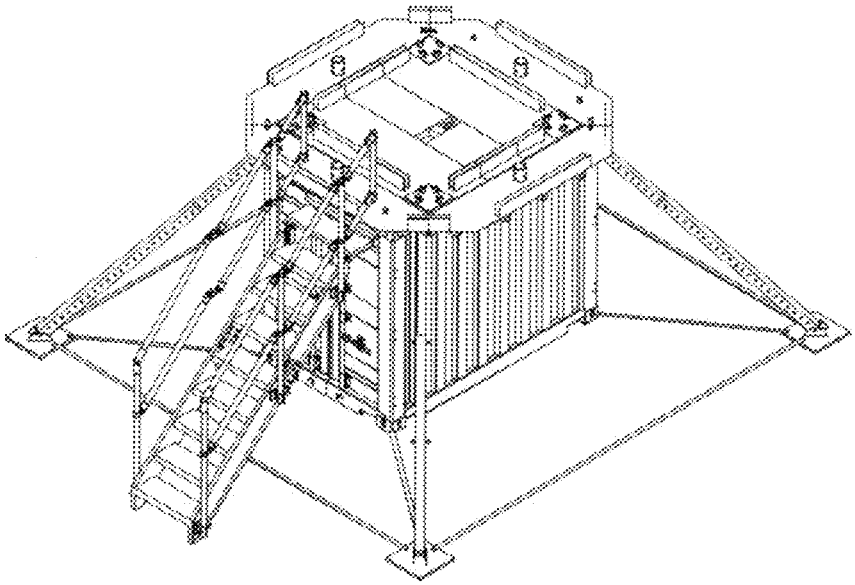
Figure 33:
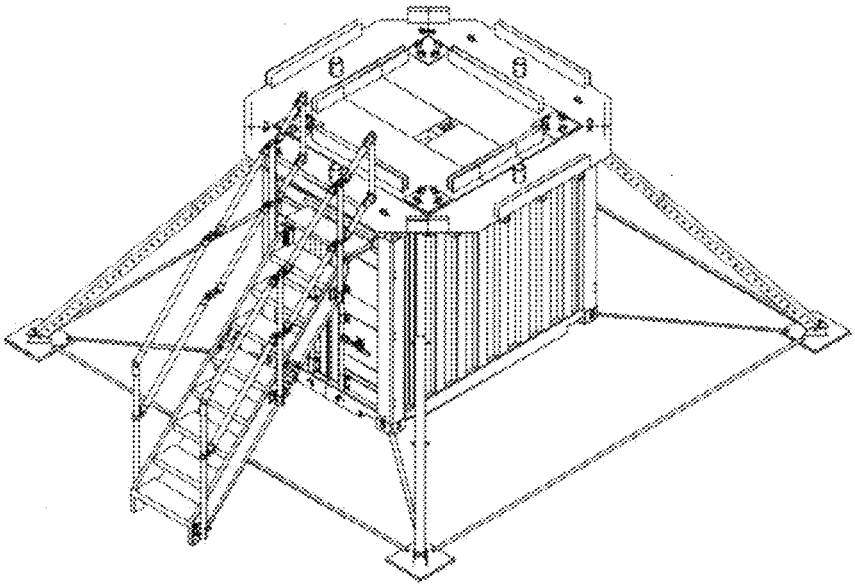

FIG. 32B is an isometric depiction showing the upper and lower railing pieces having been inserted into their mounts on the side of the stair section. The railing pieces, upper and lower, may be connected on each side of the stairs with standard pins, and also may be connected together on each side with railing pins to complete the handrail assembly.

Figure 33:
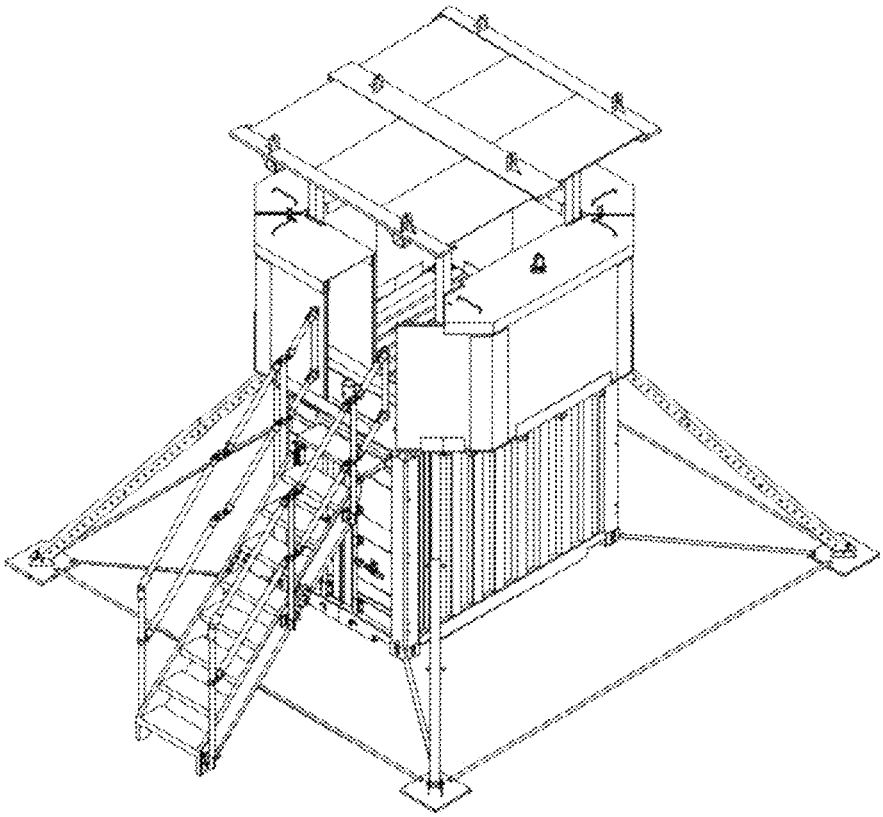

FIG. 33 is an isometric depiction showing the flat bottom pins having been inserted through the look down pins at the Quadcon container corners in order to secure the floor.

Figure 34:
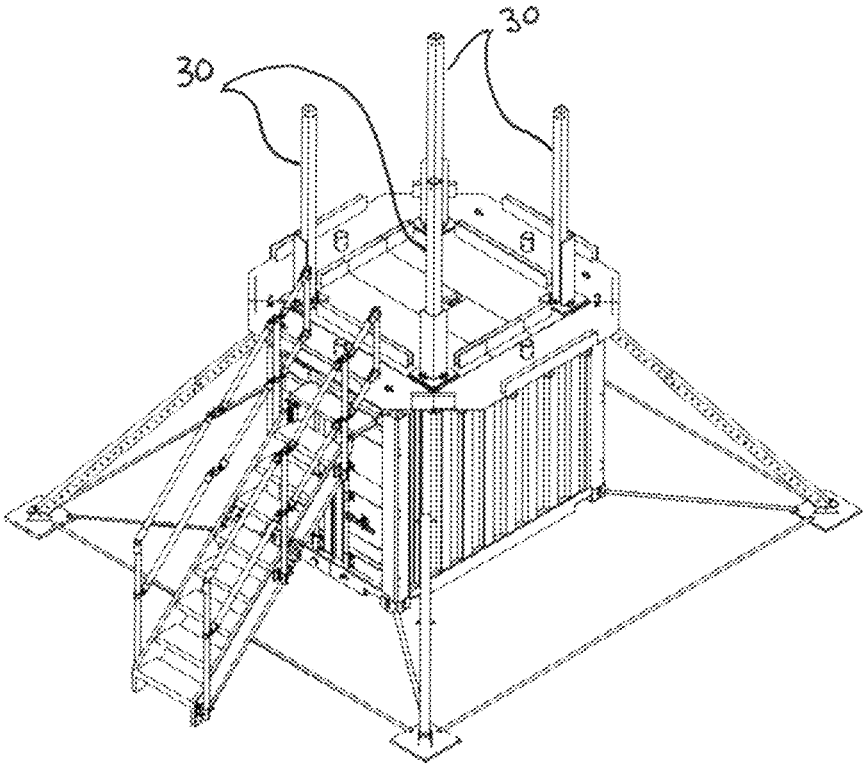
Figure 33:
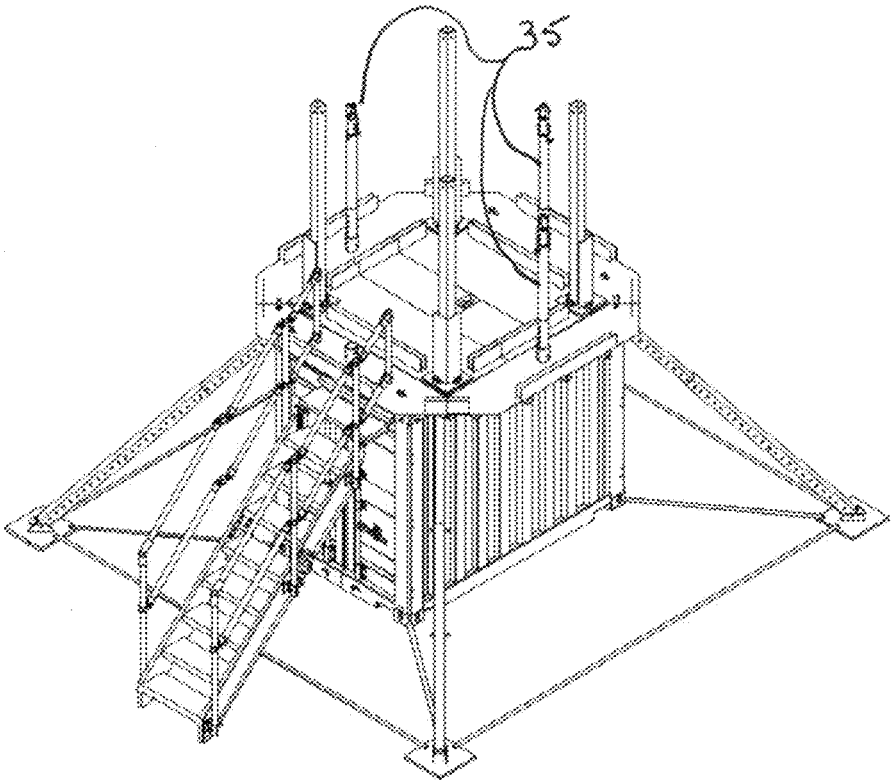

FIG. 34 is an isometric depiction showing four roof columns in place which have been pinned to the floor with flat bottom pins. Flat bottom pins increase the stability of the roof columns by reducing rocking, i.e., decreasing the range of motion of the pinned connection.

FIG. 35 is an isometric depiction of an embodiment of the guard tower in the invention having weapons mounts wherein the three folly assembled pintle pedestals (35) have been placed and pinned to the floor section. A pintle bearing sleeve and a pintle adapter are slidably engaged, inserted into the top of each of the three pintle pedestals and pinned in place with T-handle pins.

Figure 36:
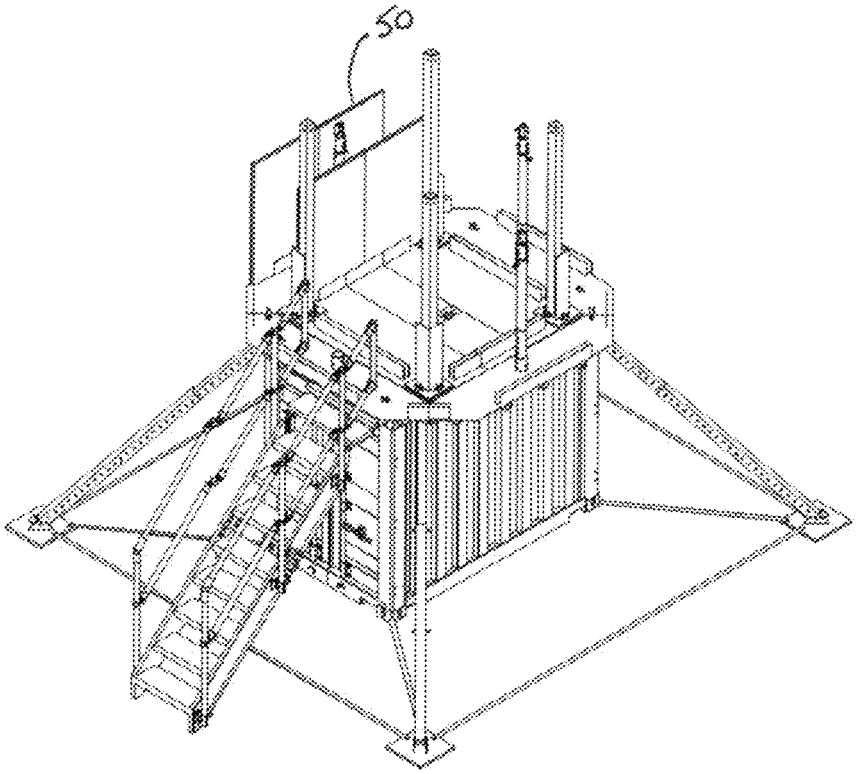

FIG. 36 is an isometric depiction of an embodiment of the guard tower of the invention having double wall panels forming a cavity between them. In this embodiment of the invention the E-glass panels (50) are placed into the slots on the floor on a first side of the guard tower.

Figure 37:
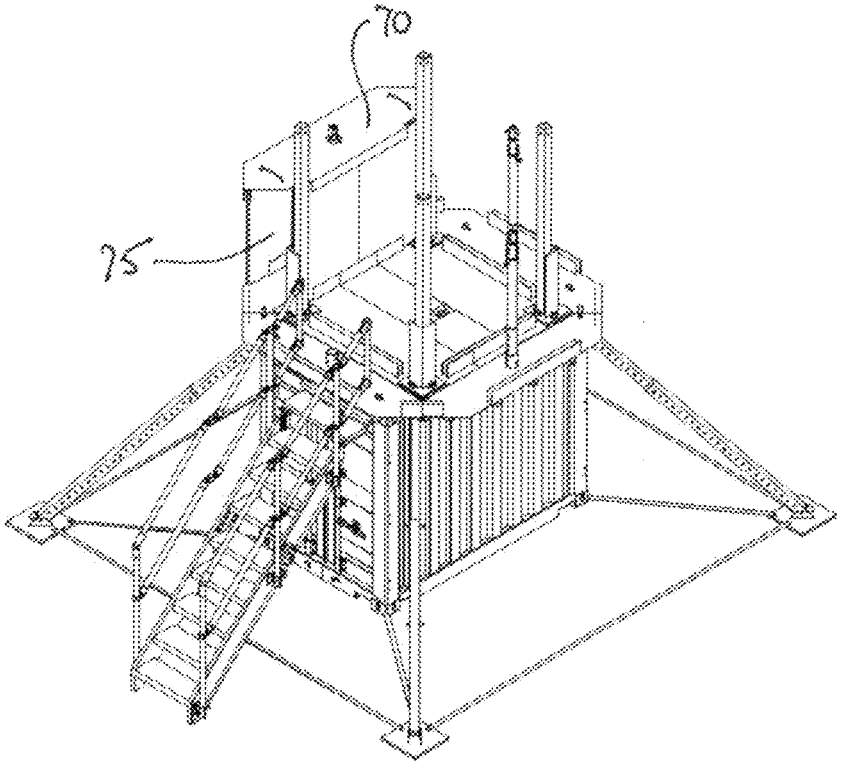

FIG. 37 is isometric depiction wherein the full window sill (70) has been placed over E-glass panels on the first side, the E-glass panels fitting into slots on the underside of the full window sill (70) and thereby forming a cavity (75) between the inner and outer E-glass panels.

Figure 38:
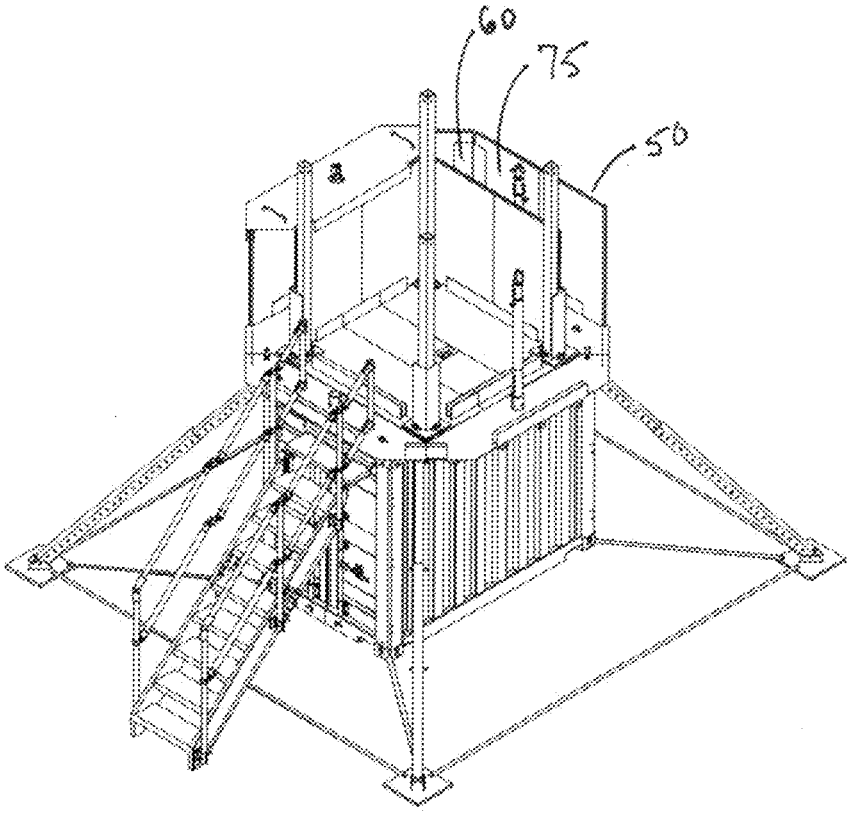
Figure 33:
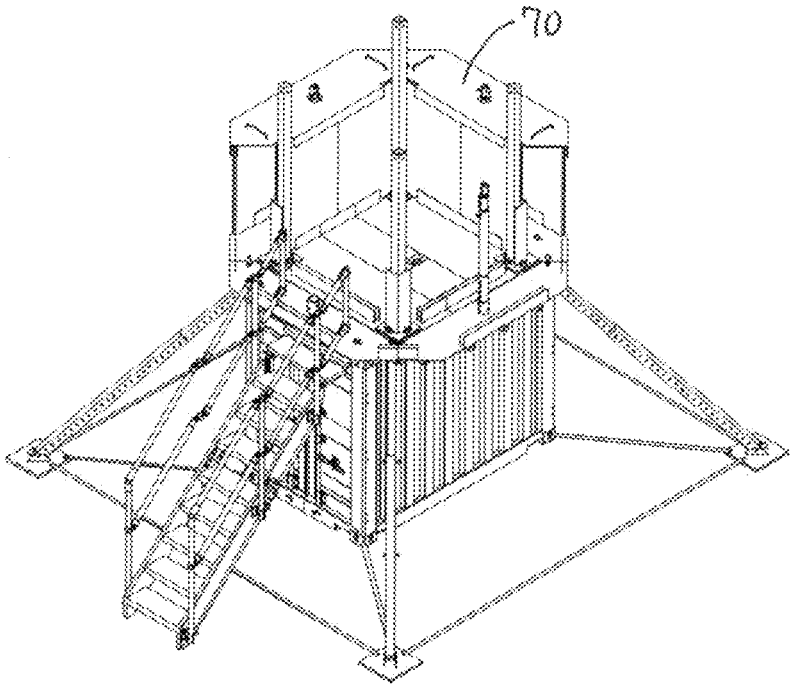

FIG. 38 is an isometric depiction of an embodiment of the guard tower of the present invention showing (i) the positioning of two corner sleeves with two half size E-glass panels therebetween on the outer perimeter the guard tower (ii) and the placement of full-size E-glass panels on a second side of the guard tower.

FIG. 39 is an isometric depiction showing the full window sill on top of the E-glass panels of the second side.

Figure 40:
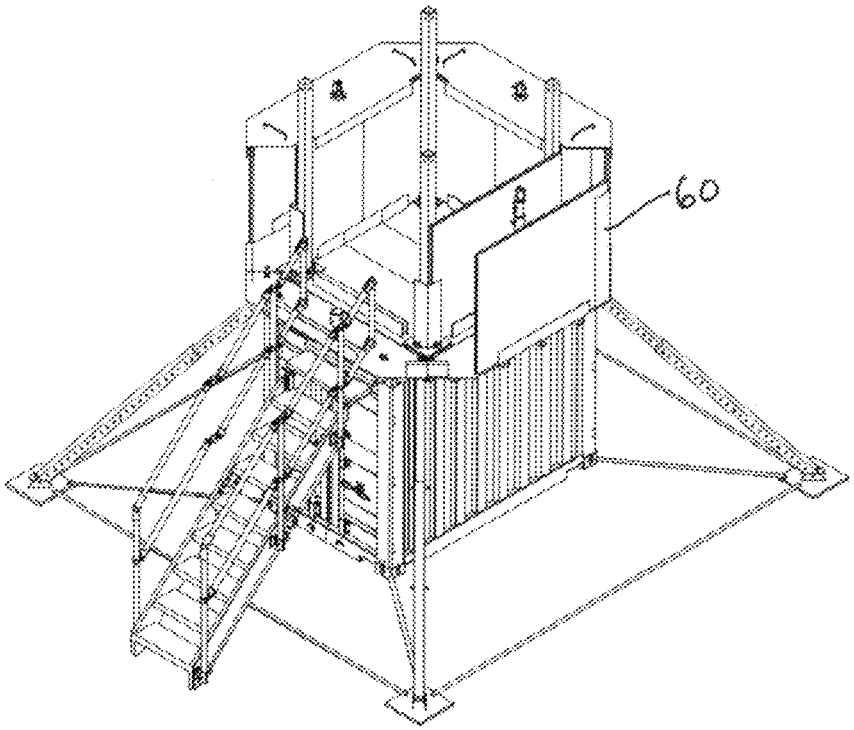

FIG. 40 is an isometric depiction showing two corner sleeves placed between the second and third side and two half size E-glass pieces in between them. The figure further shows inner and outer full size E-glass pieces for the third side.

FIG. 41 is an isometric depletion of the full window sill having been placed over the E-glass panels on the third side.

Figure 42:
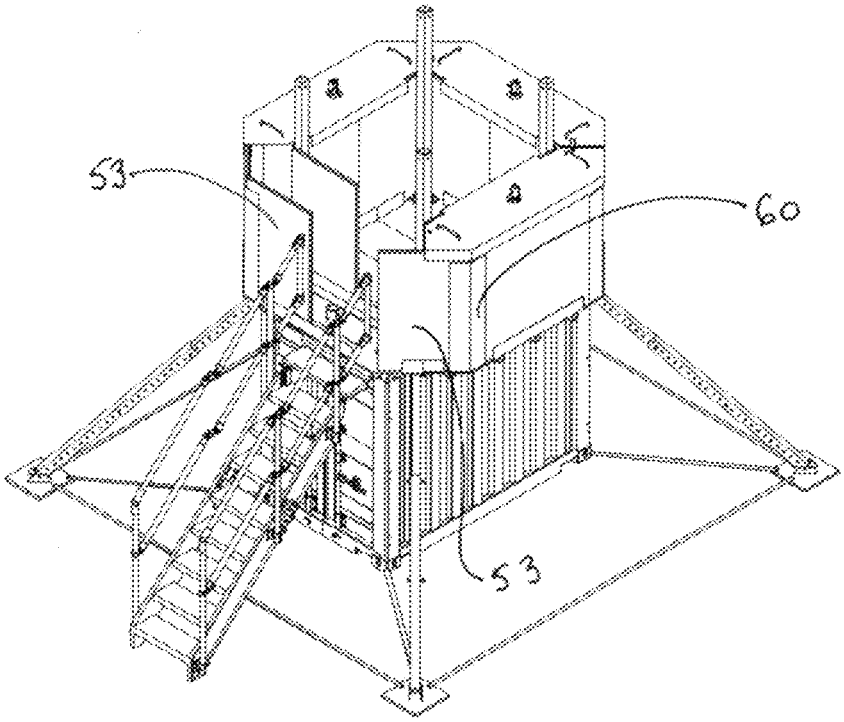
Figure 43:
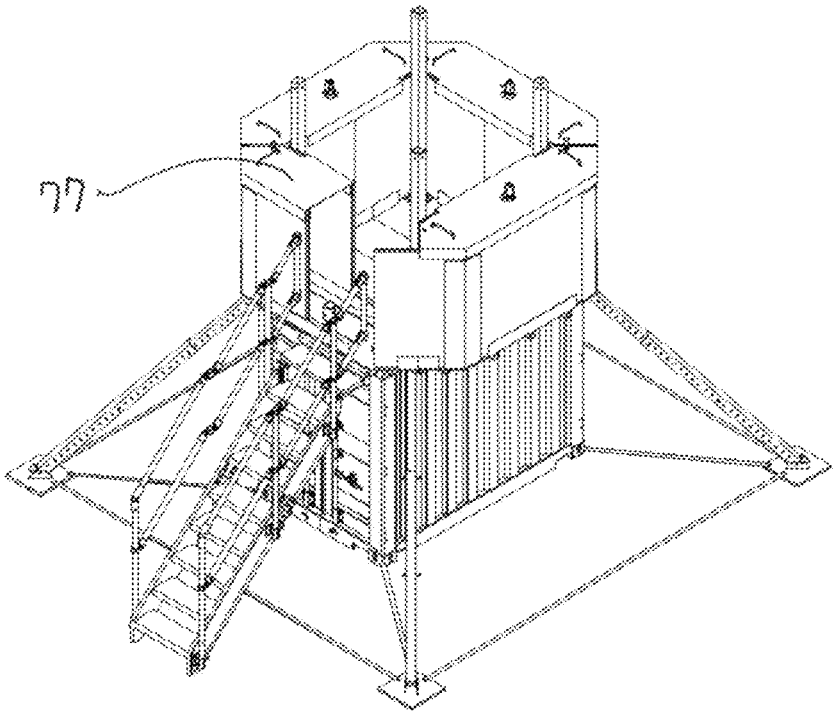

FIG. 42 is as isometric depiction wherein the bottom of the half size E-glass panels on the stair side of the guard tower of the present invention have been placed into slots on the bottom floor section.

Figure 43:
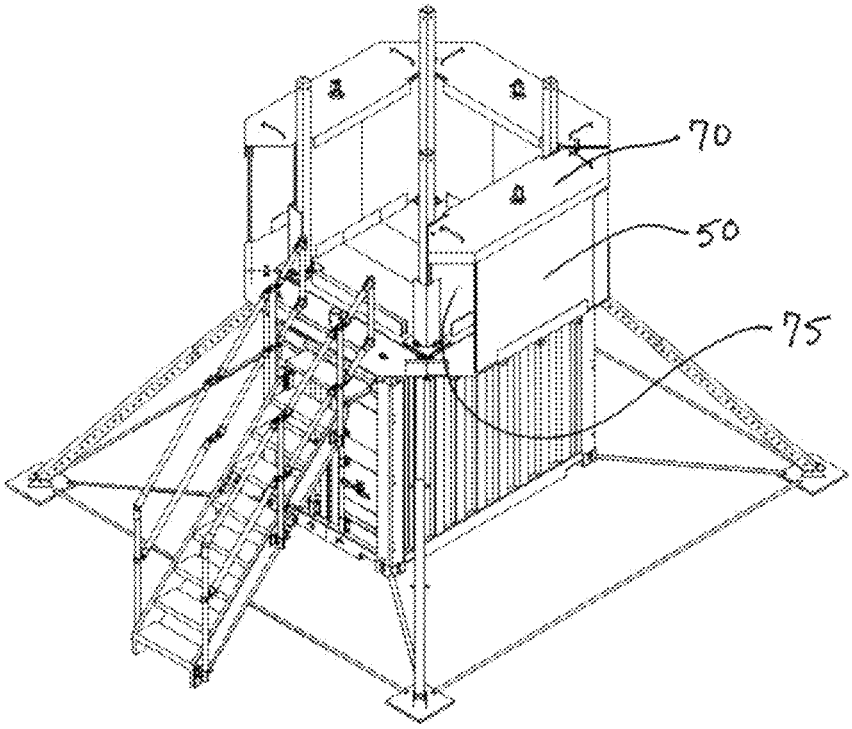

FIG. 43 is an isometric depiction showing the placement of the half sill piece on the top of the four (two per inner wall and outer wall) half E-glass panels on the entry side of the guard tower of the present invention.

Figure 44:
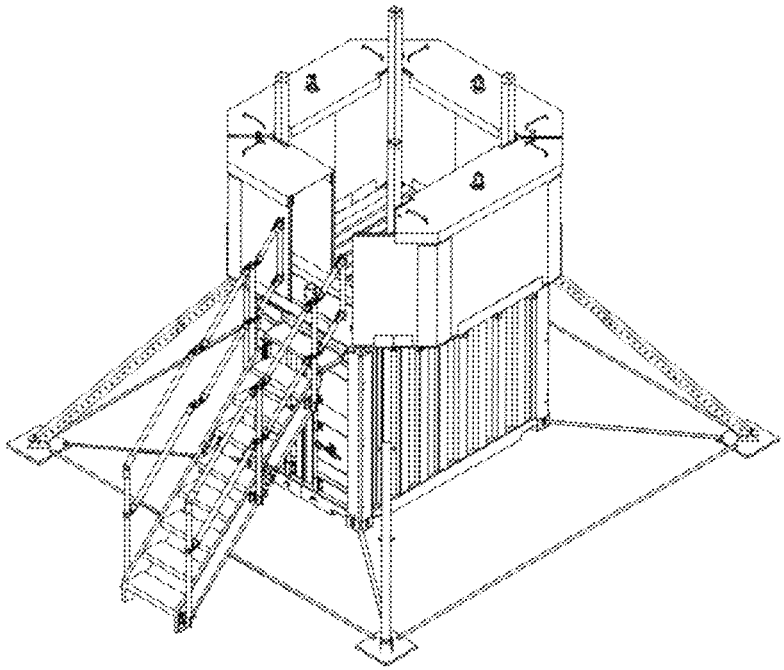

FIG. 44 is an isometric depiction showing the placement of 3 E-glass panels on the floor wherein the nonslip tread tape has been placed upward on the top panel of the three panels.

FIG. 45 is an isometric depiction where longitudinal roof beam extensions (86) have been placed into the longitudinal roof beam center sections (80), and pinned with standard pins. Then the so-assembled roof beams (80, 86) have been installed on top of the roof support columns (30) and pinned with standard pins.

Figure 46:
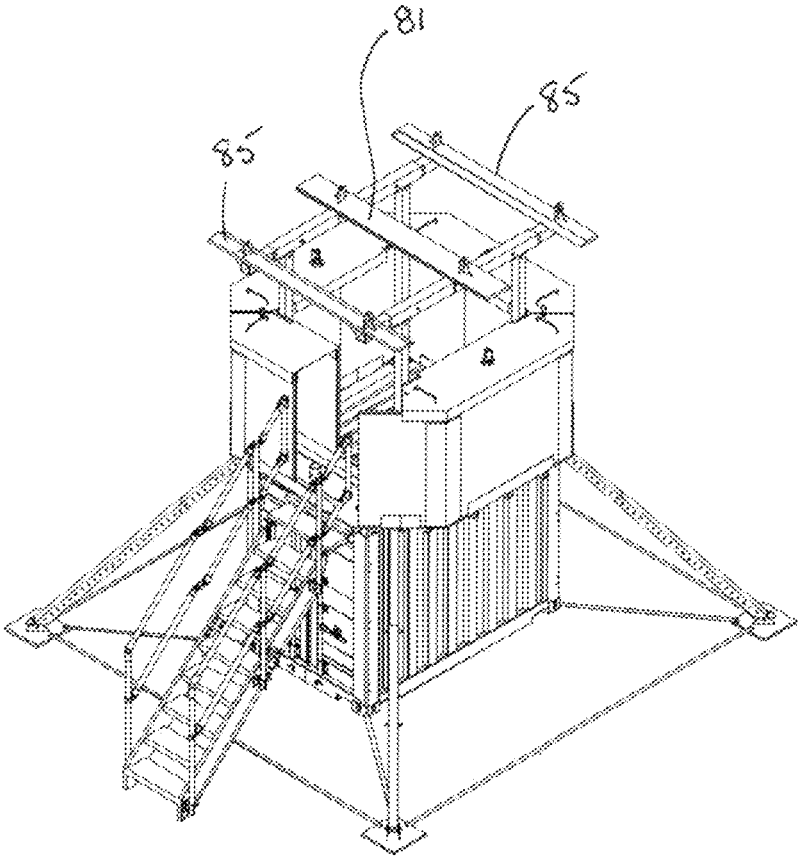

FIG. 46 is an isometric depletion wherein the middle transverse roof beam (81) and the transverse roof end beams (85) have been placed transverse to the longitudinal roof beams and pinned with standard pins to the longitudinal roof beams.

Figure 47:
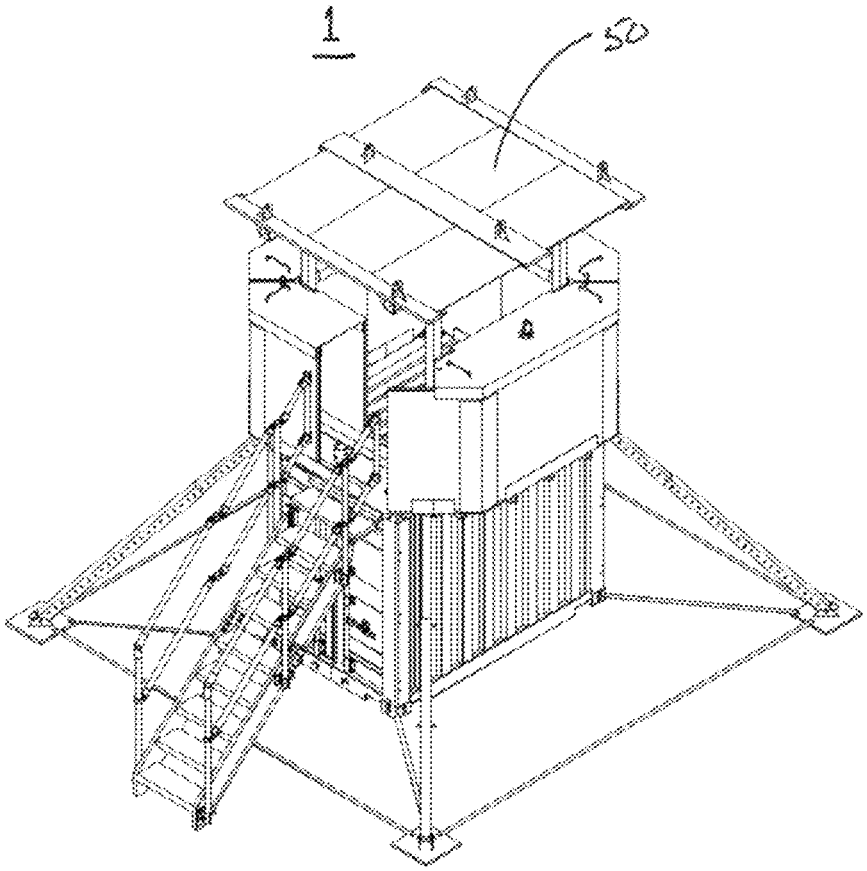
Figure 48:
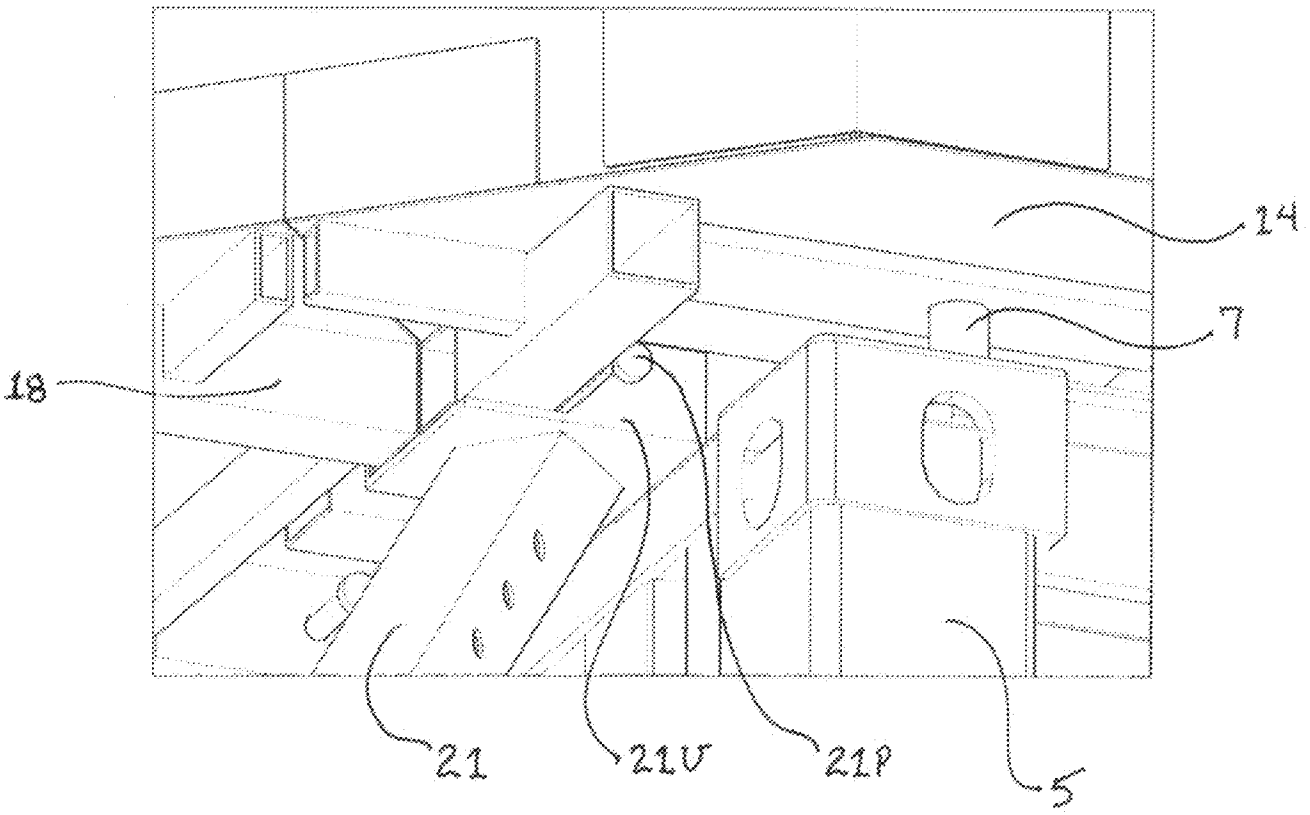

FIG. 47 is an isometric depiction showing the fully assembled guard tower (1). The figure also shows the (completed) final assembly steps of the roof E-glass panels to the transverse roof end beams. The transverse roof end beams are slid out to a second position and pinned. The roof E-glass panels are then inserted into the slots on the transverse roof end beams. Then the transverse roof end beams are unpinned, slid back into a first position where the E-glass panels are fully engaged into the slots on both sides, and then pinned into that folly engaged position. This method and configuration allows for the roof to be assembled from underneath, which allows for lower hazard from injury due to falling while the assembly is taking place.

FIG. 48 is an isometric depiction from an upward looking vantage point showing the engagement of the upper stabilizing arm section (21) and upper flange (21U) with the assembled floor sections (14, 18), as well as the spatial relationship between these elements in assembled form and the Quadcon base (5) and pin (7). Pin (21P) (pin head shown in this view) attaches upper flange (21U) to both floor sections (14, 18) via holes provided therein for such attachment.

FIG. 49 is an isometric depletion from an upward looking vantage point, at a slightly different view angle than FIG. 48, showing the engagement of the upper stabilizing arm section (21) and upper flange (21U) with the assembled floor sections (14, 18), as well as the spatial relationship between these elements in assembled form and the Quadcon base (5) and pin (7). Pin (21P) (tapered pin end opposite pin head shown in this view) attaches upper flange (21U) to both floor sections (14, 18) via holes provided therein for such attachment.

Figure 50:
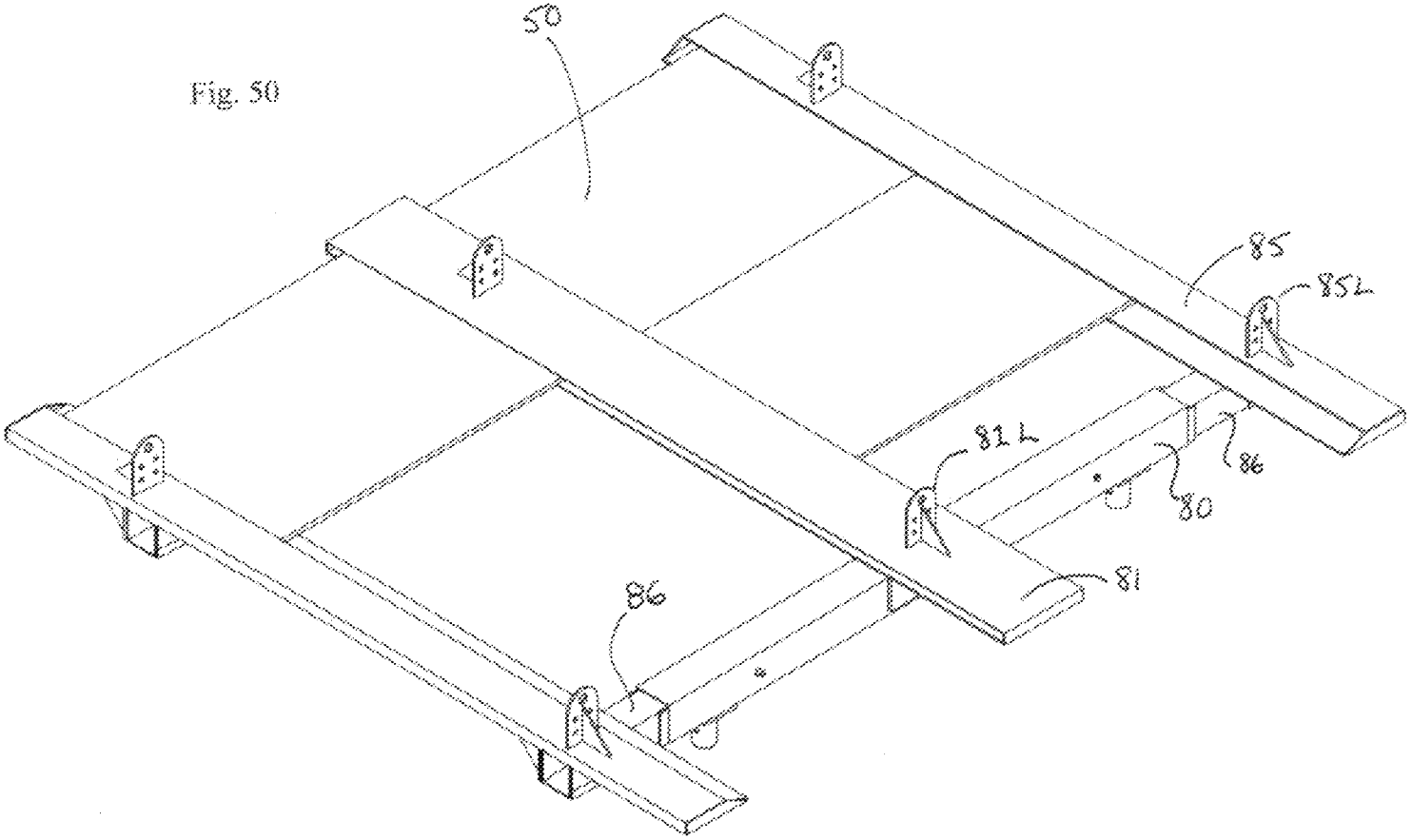

FIG. 50 is an isometric depiction showing the partially assembled roof in detail with 3 E-glass panels removed. Optional lugs/attachment means (81L, 85L) are shown for the middle transverse roof beam (81L) and the transverse roof end beams (85L).

Figure 51:
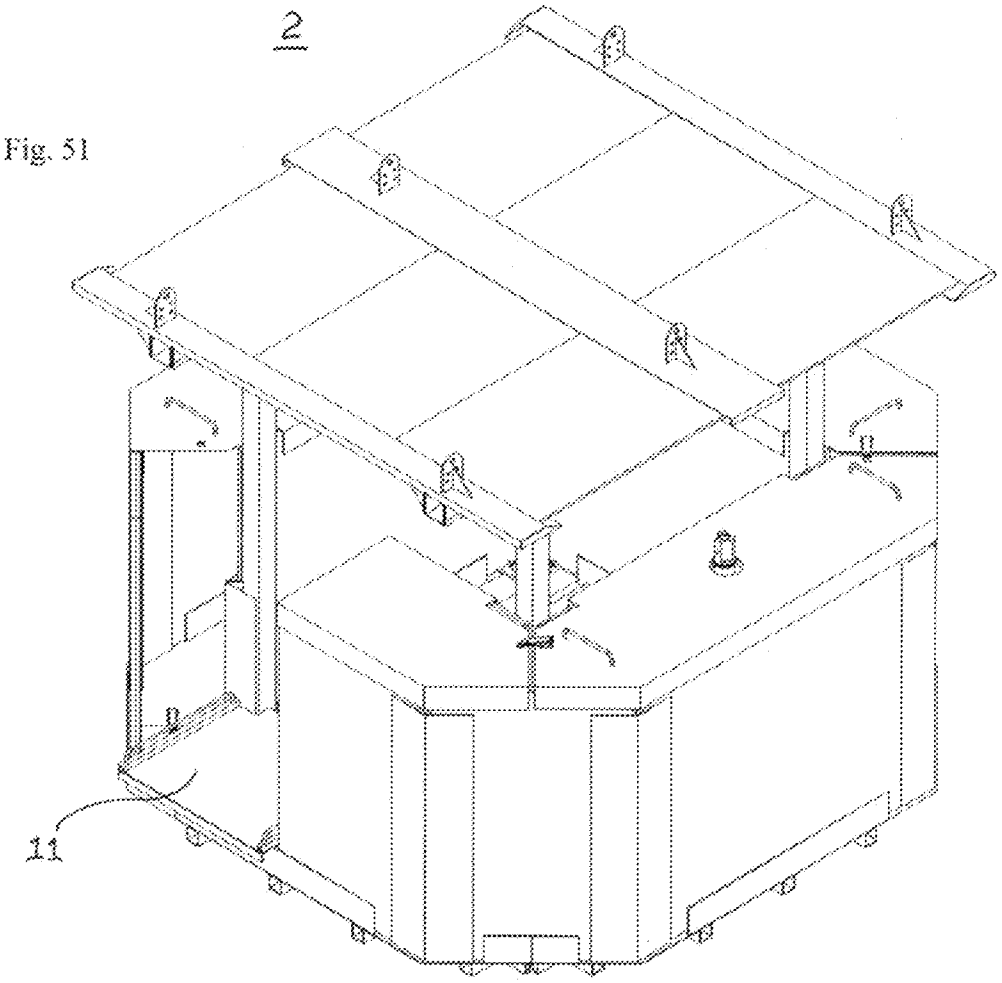

FIG. 51 is an isometric depiction from a downward view-point showing a fighting position (2) embodiment in accordance with the invention. The entry cover (11) can be seen clearly in this Figure, which may function to reduce tripping hazards and ease of entry and egress.

Figure 52:
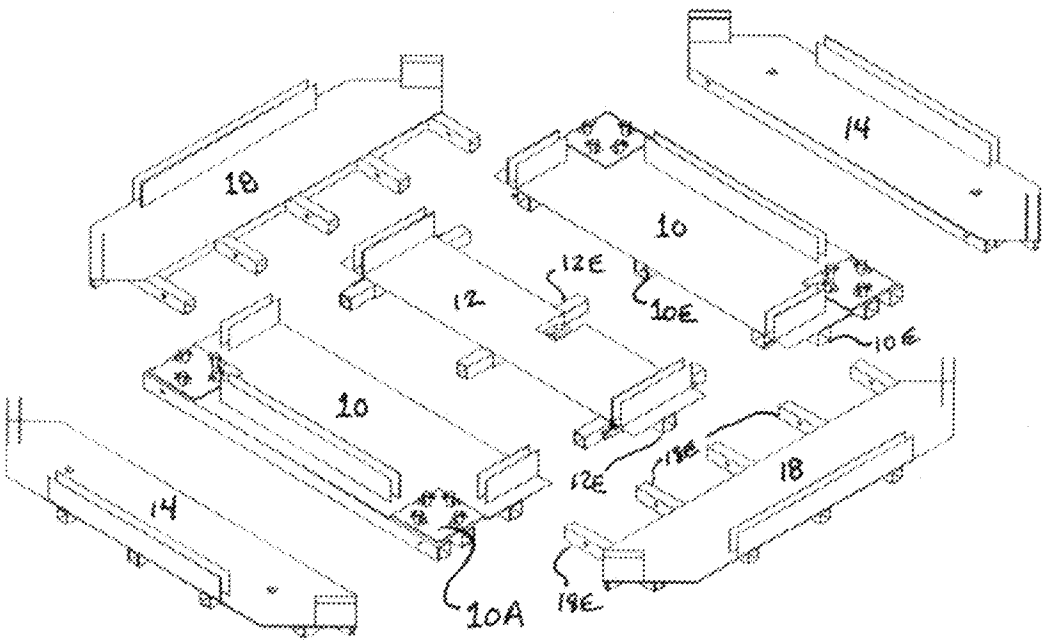

FIG. 52 is an exploded view isometric depiction of the full floor panel. Also shown are column attachment points 10A wherein flat bottom pin (6) is used as a column pin to attach the bottom of the four columns (30) to the floor. It has a flattened bottom edge allowing it to be placed more closely to the floor. This reduces the rotation or angle, i.e., the extent and amount to which the columns may move once they are pinned in place. This creates greater stability for the structure, including the roof in certain embodiments of the invention.

FIG. 52 also shows, as discussed above, that the inner floor panel maybe split into separate pieces (10, 12, 10) which are slidably engaged, via engagement members 10E and 12E in order to reduce the weight of a single piece inner floor panel. They also may be latched together in certain embodiments of the present invention with latches (71) similar to those shown in FIG. 7A which may be used to latch together window sills, one to the other. The sills may also be provided with handles to facilitate their easy handling during assembly and disassembly and also to prevent pinch points. FIG. 52 shows the slidable engagement of side floor panels (18) to the inner floor panel via engagement members 10E, 12E and 18E.

Weapon mounts (35) may be added in certain embodiments of the present invention. In embodiment of the invention weapon mounts may be placed into a cavity (75) between the inner and outer walls.

In certain embodiments of the invention, a ladder may be used for access to the guard tower of the present invention. In embodiments of the invention, a stairway may be used for access to the guard tower of the present invention. If desired, the guard tower stairway may have a railing.

In embodiments of the invention the roof system may have anchors/lugs (81L, 85L) attached to the top of it. Latches may or may not be used in embodiments of the invention to link roof elements together.

Floor armor plates may be provided, and they also may be provided with grip tape to reduce slipping hazards. In embodiments of the invention, latches are provided on the sills to connect the individual sill pieces together.

The appended claims are not intended to be limited to the features shown in any of the particular embodiments described herein, and as such are entitled to the scope of a full range of embodiments that fall within their metes and bounds.

What is claimed is:

1. A modular, rapidly-deployable, hand-assembled, guard tower or fighting position structure designed to withstand both horizontal and vertical loads, and having a no-moment stabilizer arm system, said guard tower or fighting position structure comprising:

(a) a base having a plurality of attachment points, (b) a modular floor panel having four corners, said floor panel having a perimeter having channel material for receiving wall panels attached thereto, wherein said floor panel is in connection with said base at said plurality of attachment points, (c) at least one variable length, extendable stabilizer arm extending outwardly from each of said four inner floor panel corners, and having a proximate end and a distal end, said proximate end attached to one of said four inner floor panel corners and, said distal end terminating in a stabilizer pad in contact with a surface, wherein each stabilizer pad is connected to three tensioning means, two of said three tensioning means being attached to the adjacent stabilizer pads to the left and right, and the remaining third tension means attached to a closest point of said base, wherein a total of eight tensioning means attach and tension four stabilizer arms to each other and to the base to form a stabilizer system which acts to resist a tipping movement of the guard tower by placing one or more of the stabilizer arms in simple compression, (d) at least four columns, having bottoms attached to and extending upwardly from said four inner floor panel corners, and tops, (e) front, back, and opposed side wall panels having bottom edges and top edges, and extending upwardly from and having said bottom edges slidably engaged with the floor panel perimeter channel, (f) front, back, and two opposing side window sills having a top and a bottom and having channel material attached to the bottom of each of said window sills for receiving the top edges of said wall panels, and (g) a roof assembly attached to the tops of said four columns, wherein said roof assembly comprises two extendable longitudinal roof beams, each attached to a pair of the four columns, and running in a parallel direction to the two opposing sides of the inner floor panel, a middle transverse roof beam having channels on either side thereof to slidably receive to roof panels, said middle roof beam attached to said two longitudinal roof beams in a position transverse to said two longitudinal roof beams, and central to front and back ends of said longitudinal roof beams, a transverse front roof end beam attached in a position transverse to said two longitudinal roof beams and at a front end of the structure, said transverse front roof end beam having a channel on a side facing the middle roof beam to slidably receive roof panels, said channel having an extended bottom lip, a transverse back roof end beam attached in a position transverse to said two longitudinal roof beams and at a back end of the structure, said transverse back roof end beam having a channel on a side facing the middle roof beam to slidably receive roof panels, said channel having an extended bottom lip, and roof panels extending between said middle roof beam and said front roof end beam, and roof panels extending between said middle roof beam and said back roof end beam, wherein the extended lip allows installation of the roof panels from an underneath protected position by slidably engaging said panels between said beams in a position wherein the distance between beams is greater than a final position and said panels are supported by said extended lip, and then moving the beams to a final position wherein they are fully engaged in said channels in said final beam position.

2. The guard tower or fighting position of claim 1 weighing 8,000 pounds or less.

3. The guard tower or fighting position of claim 1 being capable of assembly by a group of five soldiers in 60-120 minutes.

4. The guard tower or fighting position of claim 1 being capable of disassembly and re-assembly, said re-assembly occurring at a different location from said assembly.

5. The guard tower of claim 1 an elevated base and further comprising entry means slidably engaged with said modular floor panel, said to entry means selected from the group consisting of a ladder and a stairway.

6. The guard tower of claim 5 having an opening in said wall panels, said outer wall panels and said window sills corresponding to the placement of the entry means.

7. The guard tower of claim 1 wherein said base is an ISO Quadcon Type IIA container having approximate dimensions of 96" length by 57.38" width by 82" height.

8. The guard tower of claim 7 in kit form wherein all disassembled parts are placed within the base, said base acting as a shipping and storage container for the disassembled parts.

9. The guard tower of claim 7 wherein said base is at an incline angle of 10° from horizontal.

10. A modular, rapidly-deployable, hand-assembled, guard tower or fighting position structure designed to withstand both horizontal and vertical loads, said guard tower or fighting position structure comprising:

(a) a base having a plurality of attachment points, (b) a modular floor panel comprising: (i) an inner floor panel having a front side, a back side opposed to said front side, and two opposing sides, said front, back and two opposing sides defining an inner floor panel perimeter having four corners, said inner floor panel perimeter having channel material for receiving wall panels slidably engaged thereto, (ii) a front floor panel and a (iii) back floor panel, each of said front and back floor panels having an inner edge, and in contact with the opposed front and back side of the inner floor panel at said inner edges, respectively, two (iv & v) opposing side floor panels, each of said side floor panels having an inner edge, and being slidably engaged with the inner floor panel and in contact with the opposed sides of the inner floor panel at said inner edges, said front floor panel, back floor panel and two side floor panels defining a outer floor perimeter comprising a front, back and two sides, said outer floor panel perimeter having channel material for receiving wall panels attached thereto, wherein said floor panel is in connection with said base at said plurality of attachment points, (c) having four variable length, extendable stabilizer arms, one extending outwardly from each of said four inner floor panel corners, and having a proximate end and a distal end, said proximate end attached to one of said four inner floor panel corners and, said distal end terminating in a stabilizer pad in contact with a surface wherein each stabilizer pad is connected to three tensioning means, two of said three tensioning means being attached to the adjacent stabilizer pads to the left and right, and the remaining third tensioning means attached to a closest point of said base, wherein a total of eight tensioning means attach and tension four stabilizer arms to each other and to the base to form a stabilizer system which acts to resist a tipping movement of the guard tower by placing one or more of the stabilizer arms in simple compression, (d) at least four columns, having bottoms attached to and extending upwardly from said four inner floor panel corners, and tops, (e) front, back, and opposed inner side wall panels having bottom edges and top edges, and extending upwardly from and having said bottom edges slidably engaged with the inner floor panel perimeter channel, (f) front, back, and opposed outer side wall panels having bottom edges and top edge, and extending upwardly from and having said bottom edges slidably engaged with the outer floor panel perimeter channel, (g) front, back, and two opposing side window sills having a top and a bottom and having inner and outer channel material attached to the bottom of each of said window sills for receiving the top edges of said inner and outer wall panels, respectively and slidably engaged therewith to form an inner and outer wall having a cavity therebetween, and (h) a roof assembly attached to the tops of said four columns, wherein said roof assembly comprises two extendable longitudinal roof beams, each attached to a pair of the four columns, and running in a parallel direction to the two opposing sides of the inner floor panel, a middle transverse roof beam having channels on either side thereof to slidably receive roof panels, said middle roof beam attached to said two longitudinal roof beams in a position transverse to said two longitudinal roof beams, and central to front and back ends of said longitudinal roof beams, a transverse front roof end beam attached in a position transverse to said two longitudinal roof beams and at a front end of the structure, said transverse front roof end beam having a channel on a side facing the middle roof beam to slidably receive roof panels, said channel having an extended bottom lip, a transverse back roof end beam attached in a position transverse to said two longitudinal roof beams and at a back end of the structure, said transverse back roof end beam having a channel on a side facing the middle roof beam to slidably receive roof panels, said channel having an extended bottom lip, and roof panels extending between said middle roof beam and said front roof end beam, and roof panels extending between said middle roof beam and said back roof end beam, wherein the extended lip allows installation of the roof panels from an underneath protected position by slidably engaging said panels between said beams in a position wherein the distance between beams is greater than a final position and said panels are supported by said extended lip, and then moving the beams to a final position wherein said roof panels are fully engaged in said channels in said final beam position.

11. The guard tower or fighting position of claim 10 weighing 8,000 pounds or less.

12. The guard tower or fighting position of claim 10 being capable of assembly by a group of five soldiers in 60-120 minutes.

13. The guard tower or fighting position of claim 10 being capable of disassembly and re-assembly, said re-assembly occurring at a different location from said assembly.

14. The guard tower of claim 10 having an elevated base and further comprising entry means slidably engaged with said modular floor panel, said entry means selected from the group consisting of a ladder and a stairway.

15. The guard tower of claim 10 having an opening in said inner wall panels, said outer wall panels and said window sills corresponding to the placement of the entry means.

16. The guard tower or lighting position of claim 10 wherein said inner floor panel is comprised of a middle section, and two end sections.

17. The guard tower of claim 10 wherein said base is an ISO Quadcon Type IIA container having approximate dimensions of 96" length by 57.38" width by 82" height.

18. The guard tower of claim 10 wherein said base is at an incline angle of 10° from horizontal.

19. The guard tower of claim 10 wherein said base is oriented such that the approximate 96" length is under and supports said (i) an inner floor panel, said (ii) a front floor panel and said (iii) back floor panel, and wherein said side floor panels (iv & v) have cantilever means which insert into said interior floor panel, said side floor panels extending over and overhanging said approximate 57.38" width dimension.

20. The guard tower of claim 10 in kit form wherein all disassembled parts are placed within the base, said base acting as a shipping and storage container for the disassembled parts.

* * * * *